US009513572B2

(12) United States Patent
Gila et al.

(10) Patent No.: US 9,513,572 B2
(45) Date of Patent: Dec. 6, 2016

(54) CONTROL FOR A NON-CONTACT CHARGING ROLLER

(71) Applicant: HEWLETT-PACKARD DEVELOPMENT COMPANY, L.P., Houston, TX (US)

(72) Inventors: Omer Gila, Palo Alto, CA (US); Seongsik Chang, Palo Alto, CA (US); Michael H Lee, Palo Alto, CA (US); Thomas Anthony, Palo Alto, CA (US); William D Holland, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/652,367

(22) PCT Filed: Jan. 30, 2013

(86) PCT No.: PCT/US2013/023859

§ 371 (c)(1),
(2) Date: Jun. 15, 2015

(87) PCT Pub. No.: WO2014/120155

PCT Pub. Date: Aug. 7, 2014

(65) Prior Publication Data

US 2015/0309436 A1 Oct. 29, 2015

(51) Int. Cl.
*G03G 15/02* (2006.01)

(52) U.S. Cl.
CPC ..... *G03G 15/0266* (2013.01); *G03G 15/025* (2013.01); *G03G 2215/0174* (2013.01)

(58) Field of Classification Search
CPC ..... G03G 15/0266; G03G 15/025; G03G 2215/0174
USPC ..... 399/115, 168, 50
See application file for complete search history.

(56) References Cited

U.S. PATENT DOCUMENTS 5,634,179 A 5/1997 Umeda et al.
RE35,581 E * 8/1997 Nakamura ..... G03G 15/0216 399/170
5,839,029 A * 11/1998 Kataoka ..... G03G 15/0233 399/115
5,899,596 A 5/1999 Thompson
5,981,122 A * 11/1999 Obata ..... G03G 15/05 430/48

(Continued)

FOREIGN PATENT DOCUMENTS

JP 2005292454 A * 10/2005
JP 2007-034021 2/2007

(Continued)

OTHER PUBLICATIONS

Yanai, Semiconductive Member for Image Formation and Image Forming Apparatus Using the Member, JP2005-292454A, Oct. 20, 2005, Machine English Translations by JPO of Claims and Detailed Description.*

(Continued)

*Primary Examiner* — Susan Lee
(74) *Attorney, Agent, or Firm* — Dicke, Billig & Czaja, PLLC (PAT)

(57) ABSTRACT

Examples described herein relate to a control for a non-contact charging roller. For example, a charging assembly may control a selectable non-contact distance between a charge roller and an imaging surface.

13 Claims, 13 Drawing Sheets

(56) References Cited

U.S. PATENT DOCUMENTS 6,238,759 B1 * 5/2001 Meece ..... G03G 15/0233 428/323
7,366,441 B2 4/2008 Hatori
7,463,849 B2 * 12/2008 Takuma ..... G03G 21/08 399/128
7,616,908 B2 11/2009 Watanabe et al.
8,606,131 B2 * 12/2013 Shibuya ..... G03G 15/0216 399/50
2003/0072587 A1 * 4/2003 Sugiura ..... G03G 15/0208 399/176
2003/0182271 A1 * 9/2003 Lynch ..... G06F 8/10
2005/0271420 A1 * 12/2005 Arai ..... G03G 15/0266 399/176
2006/0120759 A1 * 6/2006 Higaki ..... G03G 15/025 399/176
2006/0188293 A1 * 8/2006 Narita ..... G03G 15/0233 399/176
2006/0251438 A1 * 11/2006 Uchitani ..... G03G 15/0266 399/50
2007/0025769 A1 * 2/2007 Someya ..... G03G 15/0266 399/168
2007/0091657 A1 * 4/2007 Uchitani ..... G03G 15/0266 363/65
2007/0092288 A1 4/2007 Shin et al.
2008/0044751 A1 * 2/2008 Nakamura ..... G03G 15/0233 399/159
2008/0131172 A1 6/2008 Takatsuna
2009/0311005 A1 12/2009 Nakagami et al.
2010/0215400 A1 * 8/2010 Nakamura ..... G03G 15/025 399/176
2011/0064460 A1 * 3/2011 Watanabe ..... G03G 15/0266 399/115
2012/0155896 A1 * 6/2012 Shibuya ..... G03G 15/0275 399/50
2012/0241083 A1 9/2012 Ogura
2013/0343771 A1 * 12/2013 Pines ..... G03G 15/0266 399/176
2014/0219679 A1 * 8/2014 Liu ..... G03G 15/025 399/168
2015/0277264 A1 * 10/2015 Chang ..... G03G 15/0233 399/176

FOREIGN PATENT DOCUMENTS

JP 2007065320 A * 3/2007
JP 2008096243 A * 4/2008
JP 2008129481 A * 6/2008
JP 2009145768 A * 7/2009
JP 2011053429 A * 3/2011
KR 10-2008-0023975 3/2008

OTHER PUBLICATIONS

Fay, Electrostatic Analysis of and Improvements to Electrophotographic Solid Freeform Fabrication, University of Florida, 2003, 123 pages.

* cited by examiner

CONTROL FOR A NON-CONTACT CHARGING ROLLER

BACKGROUND liquid electrophotography has revolutionized high speed and high volume printing. Via liquid electrophotography, digital printers or presses perform print jobs without films or the plates that are typically associated with traditional offset lithography. Accordingly, among other features, a press operator can change the content while the digital press is still completing other jobs, allowing digital printing services to be more nimble and flexible than printing services employing traditional offset lithography.

DETAILED DESCRIPTION

Figure 1:
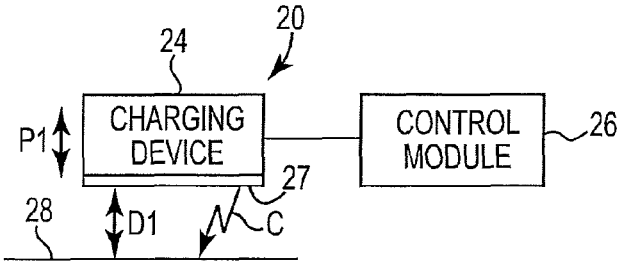
FIG. 1 is a block diagram schematically illustrating a charging assembly of a printing system, according to one example of the present disclosure.

In the following detailed description, reference is made to the accompanying drawings which form a pad hereof; and in which is shown by way of illustration specific examples of the present disclosure, which may be practiced. In this regard, directional terminology, such as "top," "bottom," "front," "back," "leading," "trailing," etc., is used with reference to the orientation of the Figure(s) being described. Because components of examples can be positioned in a number of different orientations, the directional terminology is used for purposes of illustration and is in no way limiting. Parameters such as voltages, temperatures, dimensions, and component values depend on the exact printing system implementation and are approximate for some typical Indigo printing systems. In one aspect "Ground" refers to a common return, not necessarily to any earth ground. It is to be understood that other examples may be utilized and structural or logical changes may be made without departing from the scope of the present disclosure. The following detailed description, therefore, is not to be taken in a failing sense.

At least some examples of the present disclosure provide for closed bop control of a selectable gap between a charging device and an imaging surface of a printing system in which the charge roller is in non-contact charge-transferring relation to the imaging surface. In some examples, the closed loop control mechanism enables determining a range of selectable gaps in which the charging device can provide a charge that is generally uniformly distributed across the imaging surface. In some examples, during printing operation of the printing system, the closed loop control mechanism automatically implements a selectable gap different than a selectable gap that was implemented upon during initial printing operations.

In some examples, the closed loop control mechanism evaluates the efficacy of a selectable gap according to at least an intensity of streamer discharges between the charging device (such as a charging roller) and the Imaging surface. In some examples, the closed loop control mechanism further evaluates the efficacy of a selectable gap according to additional charge characteristics, such as but not limited to, charge amplitudes and charge uniformity at the imaging surface.

In one aspect, operating a press or printing system with a charging roller to a non-contact mode (according to examples of the present disclosure) can increase longevity of an imaging surface. In particular, the lack of contact of the charge roller against the imaging surface (according to examples of the present disclosure) decreases the risk of damage or scratching of the imaging surface, which might otherwise occur due to the particles in imaging oil that sometimes escapes the cleaning unit on the press, and against which the charging roller would press if a contact mode were employed. In addition, the lack of contact of the charge roller against the imaging surface (according to examples of the present disclosure) decreases the risk of damage to, or scratching of, the imaging surface when a change roller includes a hard outer surface, against which the imaging surface would be pressed if a contact mode were employed.

In another aspect, in traditional arrangements in which the imaging surface is provided via a photoconductive foil (about a drum) having a seam region and the imaging surface is in rolling contact against the imaging surface, the charging roller can slightly fall into the seam region resulting in a minor collision of the charging roller with the foil when the charging roller exits the seam region. Such collisions typically degrade the imaging surface in that area and places wear and tear on the charging roller.

However, in examples of the present disclosure in which a charging roller is in non-contact charge transferring relation to the imaging surface, such minor collisions would not occur near a seam region of the imaging surface. Accordingly, examples of the present disclosure, in which the charging roller is maintained at a selectable gap relative to the imaging surface, act to increase the longevity of both a charging roller and an imaging surface.

In another aspect, a press or printing system is subject to numerous other variables that affect print quality, such as environmental factors like humidity, temperature, altitude, manufacturing tolerances of components. Accordingly, a closed loop control mechanism in at least some examples of the present disclosure enable real-time monitoring and adjustment of a controlled gap (e.g. spaced distance D1 in FIG. 1) according to charge characteristics that are highly correlated with printer performance and print quality. This arrangement avoids the problems that would ensue from employing an open loop systems in which a fixed, non-adjustable gap exists (between a charging roller and an imaging surface) and little or no ability is provided to evaluate charge characteristics at the imaging surface as they relate to printing performance during operation of the printing system.

In some examples, a closed loop control mechanism for positioning a charge roller in a selectable non-contact distance relative to an imaging surface forms part of a liquid electrophotography-based printing system, such as but not limited to, the indigo printing system by Hewlett-Packard Company. In one example, electrophotographic printing encompasses a print system in which a discharge source (e.g. a laser beam scanner) scans a charged imaging surface (e.g. a photoconductor) to form an electrostatic latent image on the imaging surface. A liquid ink developer of a selected color is applied to the electrostatic latent image to develop the electrostatic latent image, and the developed image is printed on a print medium via a transfer unit, such as an intermediate transfer drum and an impression drum. It will be understood that the examples of closed loop control mechanism in the present disclosure are not strictly limited to use in liquid electrophotographic printers. Rather, at least some of the examples described and illustrated herein may be applied to other type of electrophotographic printers such as, but not limited to, dry toner electrophotographic printers.

These examples, and additional examples, are described in association with FIGS. 1-22.

FIG. 1 is a block diagram schematically illustrating a charging assembly 20, according to one example of the present disclosure. As shown in FIG. 1, charging assembly 20 includes a charging device 24 and a control module 26. The charging device 24 is positioned in charge-transferring relation to an imaging surface 28 that is spaced apart from a surface 27 of the charging device 24 by selectable distance D1. The distance D1 is implemented and maintained via positioning (represented via directional arrow P1) the charging device 24 along a Z orientation. In some examples, the positioning is controlled via the control module 26.

The control module 26 causes the charging device 24 to induce air ionization discharges (represented by arrow C) between surface 27 of charging device 24 and the imaging surface 28, as later described in more detail in association with at least FIGS. 13 and 16-20. In some examples, the imaging surface 28 includes conductive properties to enable later formation of latent images on the charged imaging surface 28. In some examples, the imaging surface 28 forms part of a photoconductor, such as a photoconductive drum or a photo-conductive belt.

In general terms, the control module 26 uses measurement information obtained via charging device 24 and/or obtained at or near imaging surface 28 to evaluate charge characteristics associated with a selected spaced apart distance (D1) between the surface 27 of the charging device 24 and the imaging surface 28. Via this measurement information, a range of selectable gaps can be determined that offer reasonable printer performance and during operation of the printing system, this measurement information can be used to evaluate a selected gap and/or choose a different selected gap.

In some examples, this evaluating and implementation of the spaced apart distance (D1) is performed automatically via control module 26 according to established parameters and thresholds. In some examples, this evaluation and implementation of any potential modifications to the spaced apart distance (D1) is implemented at least partially manually in which a user authorizes implementation of a spaced apart distance (D1) recommended by the control module 26.

Figure 2:
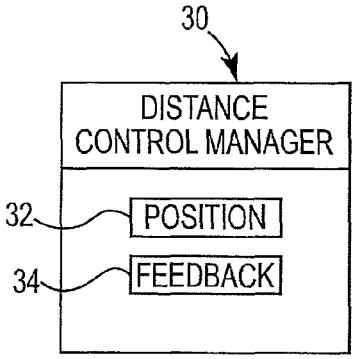
FIG. 2 is a block diagram schematically illustrating a distance control manager, according to one example of the present disclosure.

FIG. 2 is a block diagram schematically illustrating a distance control manager 30, according to one example of the present disclosure. In some examples, distance control manager 30 forms part of control module 26 (FIG. 1) and in general terms, governs the selection, implementation, maintenance, and/or evaluation of the spaced distance (D1) between the surface 27 of charging device 24 and the imaging surface 28. In some examples, distance control manager 30 includes a position function 32 and a charge feedback function 34, as shown in FIG. 2, in one example, the position function 32 implements a selected spaced distance (D1) via an electro-mechanical positioning mechanism capable of moving charging device 24 relative to the imaging surface 28 and maintaining the charging device 24 at a selected distance apart from the imaging surface 20. In one example, the feedback function 34 receives measurement information gathered at the charging device 24 and/or at the imaging surface 28 with such measurement information being indicative of the effectiveness and quality of charging of the imaging surface 28. This measurement information is used to evaluate the effectiveness of the selected spaced distance (D1) and determine if any adjustments to the selected spaced distance (D1) should be made, if so, the position function 32 implements a different selected spaced distance (D1) between the surface 27 of charging device 24 and the imaging surface 28.

Figure 3:
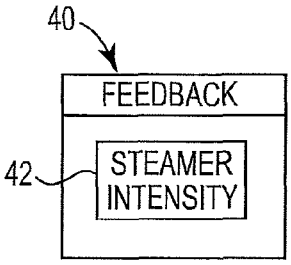
FIG. 3 is a block diagram schematically illustrating a feedback module, according to one example of the present disclosure.

FIG. 3 is a block diagram of a feedback module 40, according to one example of the present disclosure. In one example, the feedback module 40 comprises at least some of substantially the same features and attributes as feedback function 34 of distance control manager 30, as previously described m association with at least FIG. 2. As shown in FIG. 3, feedback module 40 includes a streamer intensity function 42 to monitor and evaluate characteristics of streamer discharges between the surface 27 of charging device 24 and the imaging surface 28. In some examples, these characteristics include streamer intensity, such as amplitude, peak-to-peak values of a current range, and/or a ratio of a peak current to an average current in some examples, the streamer-discharges includes filamentary-type streamer discharges. At least some aspects of such monitoring and evaluating streamer discharges are later described in more detail in association with at least FIGS. 13-20.

Figure 4:
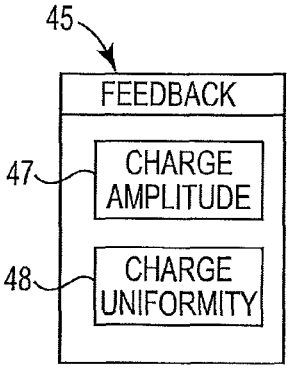
FIG. 4 is a block diagram schematically illustrating a feedback module, according to one example of the present disclosure.

FIG. 4 is a block diagram of a feedback module 45, according to one example of the present disclosure, in one example, the feedback module 45 comprises at least some of substantially the same features and attributes as feedback function 34 of distance control manager 30, as previously described in association with at least FIG. 2. In some examples, the feedback module 45 is integrated with or operates in cooperation feedback module 40 (FIG. 3).

As shown in FIG. 4, feedback module 45 includes a charge amplitude function 47 and a charge uniformity function 48 to monitor and evaluate characteristics of the amplitude of charges, and the uniformity of charges, at the Imaging surface 23, respectively. In one aspect the charge amplitude function 47 indicates a voltage level at the charged imaging surface 28 for a given spaced apart distance (D1 in FIG. 1) while the charge uniformity function 48 tracks the uniformity of charges (e.g. measurable by a voltage level) over time at Imaging surface 28. At least some aspects of such monitoring and evaluating charge amplitudes and/or charge uniformity are later described in more detail in association with at least FIGS. 19-20.

Figure 5:
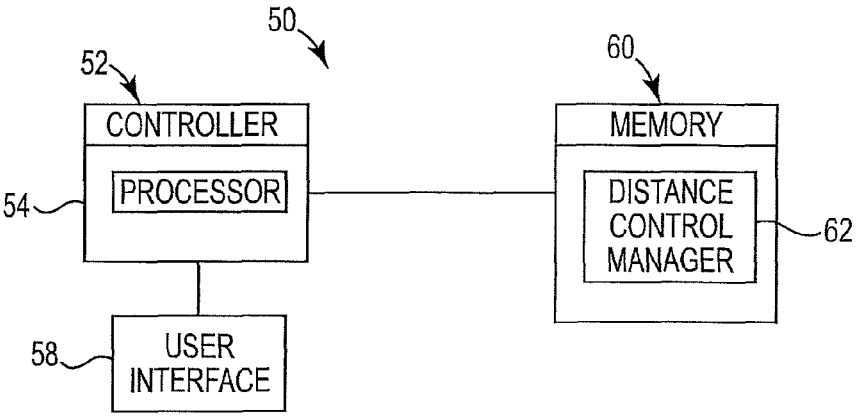
FIG. 5 is a block diagram schematically illustrating a control portion and a memory storing a distance control manager, according to one example of the present disclosure.
Figure 6:
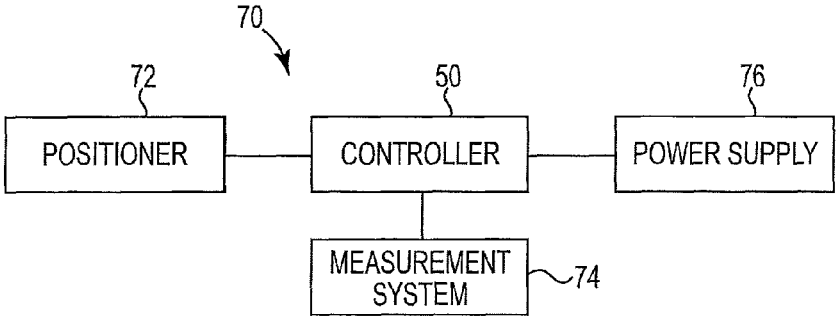
FIG. 6 is a block diagram schematically illustrating a control portion of at least a charging assembly, according to one example of the present disclosure.

FIG. 5 is a block diagram schematically illustrating a control portion 50 of a charging system, according to one example of the present disclosure. As shown in FIG. 5, control portion 50 includes at least some of substantially the same features and attributes as control module 26, as previously described in association with at least FIGS. 1-4. In some examples, control portion 50 includes a controller 52, a user interface 58, and a memory 60.

In general terms, controller 52 of control portion 50 comprises at least one processor 54 and associated memories that are in communication with memory 60 to generate control signals directing operation of at least some components of the systems and components previously described in association with at least FIGS. 1-4. In some examples, these generated control signals include directing operation of and positioning of charging device 24. In some examples, these generated control signals facilitate or govern obtaining measurement information related to the charge characteristics of a charged imaging surface 28, based on a selectable spaced apart distance (D1) between the charging device 24 and the imaging surface 28. In particular, in response to or based upon commands received via a user interface 58 and/or machine readable instructions (including software), controller 52 generates control signals to direct operation of charging device 24 and distance control manager 30, 62 in accordance with at least some of the previously described examples and/or later described examples of the present disclosure. In one example, such operation includes closed loop control of selectable gaps between a charging device and an imaging surface, in one example, controller 52 is embodied in a general purpose computer and communicates with a charging system while in other examples, controller 52 is incorporated within the charging system.

For purposes of this application, m reference to the controller 52, the term "processor" shall mean a presently developed or future developed processor (or processing resources) that executes sequences of machine readable instructions (such as but not limited to software) contained in a memory. Execution of the sequences of machine readable instructions, such as those provided via control module 26 and distance control manager 30, 62, causes the processor to perform actions, such as operating controller 52 to regulate a distance between a charging device and an imaging surface in a manner generally described in at least some examples of the present disclosure. The machine readable instructions may be loaded in a random access memory (RAM) for execution by the processor from their stored location in a read only memory (ROM), a mass storage device, or some other persistent storage (e.g. non-transitory tangible medium or non-volatile tangible medium, as represented by memory 60. In one example, memory 80 comprises a computer readable tangible medium providing non-volatile storage of the machine readable instructions executable by a process of controller 52. In other examples, hard wired circuitry may foe used in place of or in combination with machine readable instructions (including software) to implement the functions described. For example, controller 52 may be embodied as part of at least one application-specific integrated circuit (ASIC). In at least some examples, the controller 52 is not limited to any specific combination of hardware circuitry and machine readable instructions (including software), nor limited to any particular source for the machine readable instructions executed by the controller 52.

In some examples, user interlace 58 comprises a graphical user interface or other display that provides for the simultaneous display, activation, and/or operation of the various components, functions, features, and of control module 26, distance control manager 30, 62 and control portion 50, as described in association with at least FIGS. 1-5. Moreover, it will be understood that the features, functions, modules, and components of the control module 26 and distance control manager 30, 82 as described throughout FIGS. 1-5 can be arranged in different, forms and groupings, and therefore the control module 26 and distance control manager 30, 82 are not strictly limited to the particular arrangement or groupings of functions, modules, and components illustrated in FIGS. 1-3.

Figure 8:
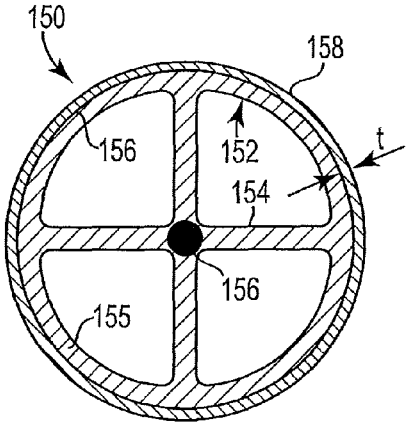
FIG. 8 is a side sectional view schematically illustrating a hollow charge roller including a resistive coating, according to one example of the present disclosure.

FIG. 8 is a block diagram schematically illustrating a control portion 70, according to one example of the present disclosure. In one example, control portion 70 includes a controller 52, a positioner 72, a measurement system 74, and a power supply 76. In some examples, controller 52 includes at least substantially the same features and attributes as controller 52, as previously described in association with at least FIG. 5. In some examples, the control portion 70 includes at least soma of substantially the same features and attributes as the features of control portion 50, as previously described and illustrated in association with FIG. 5, such as a user interface 58 and memory 80 having distance control manager 62.

In some examples, under direction from controller 52, positioner 72 acts to implement and maintain the position of charging device 24 at a selectable spaced apart distance (D1) relative to imaging surface 28, as shown in FIG. 1. In some examples, under direction from controller 52, measurement system 74 acts to obtain measurement information regarding characteristics associated with charging of imaging surface 28, such as hut not limited to, charge level (e.g. amplitude), charge uniformity, and/or streamer discharge intensity, in some examples, under direction from controller 52, the power supply 76 regulates the charge applied via chafing device 24 in a manner consistent with non-contact charging of imaging surface 20, as further described throughout this present disclosure.

Figure 7:
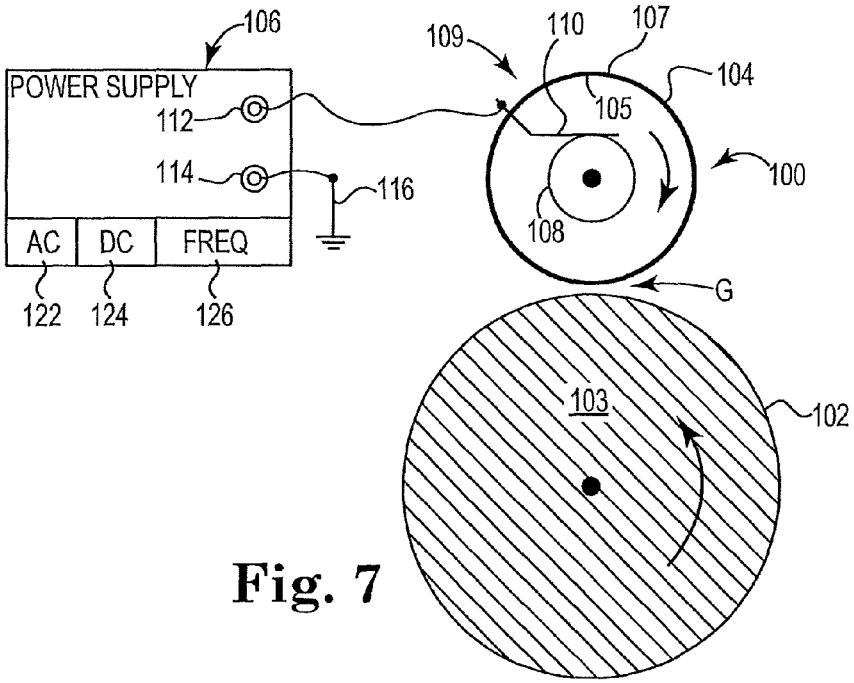
FIG. 7 is a side view schematically illustrating a print system including a charge roller with a resistive coating, according to one example of the present disclosure.

FIG. 7 is a diagram schematically illustrating a print system 100, according to one example of the present disclosure. As shown in FIG. 7, printing system 100 includes an imaging surface 102, a charge roller 104, and a power supply 106. The charge roller 104 includes a metal external surface 105 and a resistive layer 107 overlying the metal external surface 105, the details of which are further shown in at least FIG. 8. In general terms, the charging roller 104 is in non-contact, charge-transferring relation with the imaging surface 102 in order to deposit an electric charge on the imaging surface 102 during operation of a printing system for printing, such as prior to forming latent images on a charged imaging surface 28 (FIG. 1). It will be understood that the elements shown in FIG. 7 are depicted for illustrative purposes and are not necessarily to scale, for example, in at least some instances the charge roller 104 typically would be much smaller (than shown in FIG. 7) in proportion relative to the drum providing imaging surface 102.

In some examples, the power supply 108 generates a voltage potential at the metal external surface 105 of the charge roller 104. The metal external surface 105 of the charge roller 104 is disposed to deposit an electric charge on, the imaging surface 102. As shown in FIG. 7, the printing system implements employs a charge transferring relation between charge roller 104 and imaging surface 102 via a spaced apart distance (D1 in FIG. 1) between the charge roller 104 and the imaging surface 102. In at least some examples, no compositions or other conductive agents reside in the resistive layer 107 (of the charge roller 104).

In one aspect, by using a charging element having a metal external surface, the charge roller is expected to last for the lifetime of the printing system with little or no degradation. At the very least, it is expected that the charging roller with the metal external surface (and overlaid resistive coating) will exhibit much less degradation than traditional charging element having an organic polymer surface (such as conductively loaded rubber).

With this in mind, the charge roller in at least some examples of the present disclosure, the charge roller is sometimes referred to in this description as being "permanent." However, in at least some examples, the charge roller is releasably mounted in the printing system to facilitate replacement if desired.

Moreover, by charging the imaging surface 102 via a non-contact mode, greater longevity also will be achieved for imaging surface 102. In one aspect, this longevity results from avoiding the wear and tear that would otherwise occur from ongoing contact of a charge roller against the imaging surface in the presence of residue from cleaning agents or other sources.

In some examples, the printing system 100 further comprises a coupling mechanism 109. As shown in FIG. 7, in one example the coupling mechanism 109 includes a slip contact 108 (incorporated in charge roller 104, e.g. electrical brush) that is in electrical communication with a contact arm 110, which in turn, is connected to a first power output terminal 112 of the power supply 106. In some examples, the slip contact 108 is provided via a stationary brush in contact against a shaft of the charge roller 104. As further shown in FIG. 7, a second power output terminal 114 of the power supply 108 is connected to a common return 118 and through the return to the imaging surface 102. In other examples, other connection techniques are used (instead of coupling mechanism 109) to couple electric power from the power supply 100 across the charge roller 104 and the imaging surface 102.

In one example, power supply 106 charges the charge roller 104 (and thereby charges imaging surface 102) via an AC component 122, a DC component 124, or a combination of both. Power supply 106 also includes a frequency selector 126.

In one example, the charge roller 104 acts as the charging device 24 in the assembly of FIG. 1 and the imaging surface 102 of photoconductive drum 103 serves as the imaging surface 28 in assembly 20 of FIG. 1. However, in some examples, the imaging surface 28 is embodied in a belt or other structure, which in some instances presents a generally planar portion that is in charge transferring relation to the charging roller.

FIG. 8 is a sectional view of a charge roller 150, according to an example of the present disclosure. In some examples, charge roller 160 serves as the charging device 24 in the assembly 20 of FIG. 1.

As shown in FIG. 8, charge roller 150 includes a hollow cylindrical frame 152 (appearing circular in the cross-section of FIG. 8) including an outer ring 156 supported by radial struts 154, with frame 162 being rotatably mounted on axle 158. Frame 152 also includes an external surface 156. In one example, the entire frame 152 (Including external surface 156) is made of a metal material, such as hut not limited to stainless steel or aluminum. In other examples, portions of frame 152, particularly including external surface 156, are made of a metal material such as stainless steel or aluminum. In one example, the hollow cylindrical frame 152 is supported by end caps without the use of radial struts 154.

In addition, as further shown in FIG. 8, charge roller 150 includes an outer resistive layer 158 overlaid directly on top of, and in contact with, the metal external surface 156 of charge roller 150. In some examples, the outer resistive coating is disposed on a solid cylindrical body instead of the generally hollow 4 mm structure provided via frame 152 and outer ring 156.

In general terms, the outer resistive layer 158 includes an inorganic, non-polymeric material, in at least some examples, the inorganic, non-polymeric material is a coating of a hard semiconductor-based material, such as silicon carbide (SiC) while in other examples, the inorganic, non-polymeric material is a coating of an insulator material with electrically active defect states, such as a mixture of aluminum oxide ($Al_2O_3$) and titanium oxide ($TiO_2$).

In at least one example, the resistive coating 158 is at least as hard as the metal external surface (e.g. stainless steel), thereby ensuring the integrity and smoothness of the outer surface charge roller 150 over a lifetime of use. In some examples, the resistive coating 158 is substantially harder than the metal external surface (e.g. stainless steel) of the charge roller, further enhancing the longevity of the charge roller. In another aspect, longevity of the charge roller in at least some examples is achieved, at least in part via a chemical and mechanical stability of the resistive coating.

Among other features, the longevity of charge rollers in at least some examples of the present disclosure is achieved, at least in part, because the resistive coating is made from materials that are chemically stable in the environment of the printing system. In one example, the resistive coating is an inorganic, non-polymeric film of an alloy of alumina ($Al_2O_3$) and titania ($TiO_2$). This metal oxide is generally immune from chemical change by exposure to environmental chemistries, even in the presence of an atmospheric plasma. Accordingly, this aspect facilitates that a mechanical or chemical integrity of the example materials generally is not compromised during extended use in a printing application, such as when acting as an outer resistive coating of a charge roller.

Moreover, the longevity of charge rollers in at least some examples of the present disclosure, at least in part, arises from electrical stability of the inorganic material forming the outer resistive coating. In particular, conductivity is generally inherent to the inorganic material forming the outer resistive layer, and therefore is not readily lost in contrast the desired conductivity of the outer rubber portion of a traditional charge roller used for high-speed digital electrophotographic presses is artificially produced via mixing-in foreign material (conductive agents) with the elastomeric rubber material. Over time, these conductive agents leach out from the rubber material, thereby sometimes causing resistivity of the outer rubber portion to increase, which in turn, causes an increased voltage drop across the outer rubber portion of the traditional charge roller. As a result, less charging occurs on the photoconductive imaging surface, leading to lesser performance of the photoconductive imaging surface. However, due to the inherent conductivity of the inorganic material forming the outer resistive coating in examples of the present disclosure, the outer resistive coating remains generally electrically stable over time.

While some types of conductive additives (e.g. carbon black) are not as likely to leach torn the outer rubber portion of a traditional charge roller, these additives typically provide less charging uniformity than is desired.

Additionally, the longevity of charge rollers in at least some examples of the present disclosure is achieved, at least in part, because the resistive coating is made from materials that are electrically stable in the environment of the printing system, in some examples, the resistive coating is an inorganic, non-polymeric material with an electrical conductivity derived from electronic states in the material that are not altered by exposure to electric field, electric current, environmental chemistries, or atmospheric plasma. Accordingly, this aspect facilitates that the electrical resistivity and dielectric constant of inorganic, non-polymeric materials, identified in at least some examples of this disclosure for use as the resistive coating, generally do not change during extended use in a printing application, such as when acting as an outer resistive coating of a charge roller.

Furthermore, the longevity of charge rollers in at least some examples of the present disclosure is achieved, at least in part, because the metal external surface of the body of the charge roller is made of materials with sufficient hardness to resist denting, nicks, and/or other surface abrasions. In some examples, the material comprises stainless steel or aluminum. In one example, a hardness of the resistive coating is at least as great as a hardness of stainless steel.

Moreover, in some instances, the outer resistive coating has a hardness that is significantly greater than the hardness of the metal external surface of the body of the charge roller. In one example, the hardness of the outer resistive coating is more than an order of magnitude greater than the hardness of the metal external surface, such as stainless steel.

Accordingly, in add-on to the chemical and mechanical stability of the resistive coating, the hardness of the metal external surface of the body of the charge roller and the hardness of the outer resistive coating work together to ensure relative "permanency" of the charge roller when deployed in a printing system.

In addition, the charge roller enjoys greater longevity for the previously noted reasons regarding a lack of contact in the presence of residue and enjoys greater longevity by avoiding the minor collisions adjacent a seam region of a photoconductor, as previously noted.

Moreover, in at least some examples, the outer resistive coating of the charge roller has a thickness sufficient to, and is composed in a manner to, substantially suppress an intensity (e.g. amplitude and/or quantity) of filamentary streamers, which are generated in an air gap between the charge roller and a dielectric layer of the imaging surface, in one aspect, the filamentary streamer discharges occur when a charging voltage sufficient to cause air breakdown is applied between the charge roller and ground plane associated with the imaging surface (during operation of the printing system for printing). In addition, high amplitude, filamentary streamer discharges can degrade the performance of the photoconductive imaging surface.

In one example, the resistive coating causes a substantial reduction in an amplitude of the filamentary streamer discharges. For example, the presence of the resistive coating (on the metal external surface of the charge roller) can reduce the amplitude of filamentary streamer discharges by 2-10 times the amplitude of filamentary steamer discharges that would otherwise occur in the absence of a resistive coating. In further examples, the presence of the resistive coating can reduce the streamer amplitudes by more than 10 times, such as a 25 times reduction in the streamer amplitude. Further examples are described below.

In addition, with further reference to FIG. 8, the resistive coating 158 has a thickness (t).

In one example, at least the metal external surface 156 of the charge roller 150 comprises stainless steel (e.g. stainless steel 304). In another example, at least the metal external surface of the charge miter comprises aluminum (e.g. aluminum 6061).

In some examples, the resistive coating includes an inorganic, non-polymeric material such as a semiconductor material. In one example, the semiconductor material is chosen from silicon (Si), hydrogenated silicon (Si:H), or silicon carbide (SIC).

In other examples, the resistive coating includes an inorganic, non-polymeric material such as an insulator with electrically active defect states. In one example, the insulator with electrically active defect states is chosen from chromium oxide ($Cr_2O_3$), aluminum oxide ($Al_2O_3$), aluminum oxide:zinc oxide mixture (Al2O3:ZnO), aluminum oxide:tin oxide mixture (Al2O3:SnO), or aluminum oxide:titanium oxide mixture ($Al_2O_3$:$TiO_2$). In the foregoing metal oxide materials, in at least one example, electrically active defect states may be introduced by using compositions that are slightly deficient in oxygen compared to the stoichiometric oxygen composition.

In one example, the inorganic, non-polymeric resistive coating solely defines the outer layer 158 of the charge roller 150 and is in direct contact with a metal external surface 158 of a body of the charge roller 150 underlying the resistive coating. In other examples, the resistive coating does not solely define the outer layer 158 of the charge roller 150.

Figure 9:
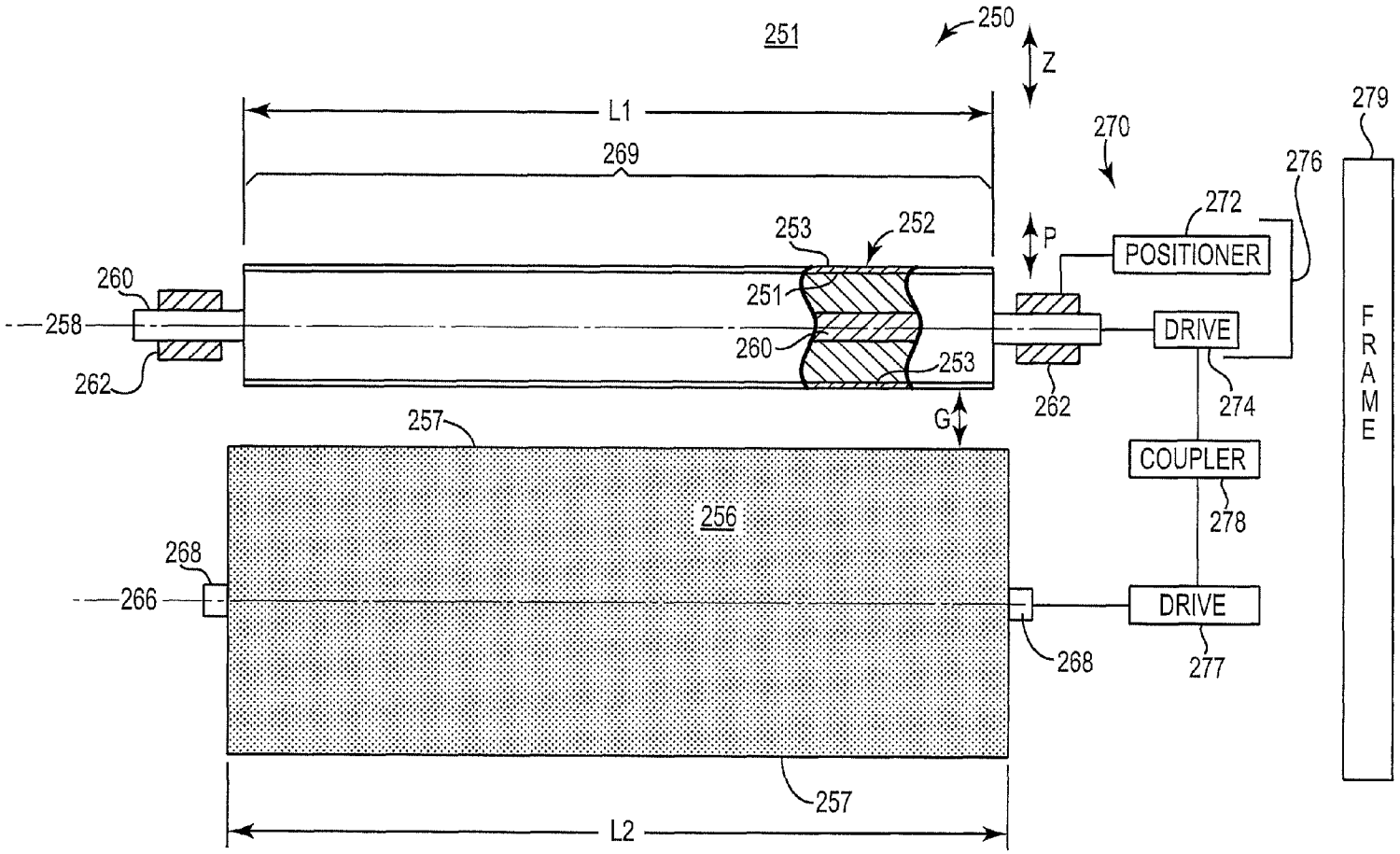
FIG. 9 is a front view schematically illustrating a charge roller in charge-transferring relation to an imaging drum while maintaining a selectable controlled gap between the charge roller and the imaging drum, according to one example of the present disclosure.

FIG. 9 is diagram 251 schematically illustrating a printing system 250, according to one example of the present disclosure. As shown in FIG. 9, as discussed below, in one example the imaging surface 257 comprises a photoconducting sheet disposed about a drum 266. Meanwhile, as shown in the partial sectional view in FIG. 9, the charge roller 252 includes a roller or drum having a metal external surface 251 and an outer resistive layer 253. It also will be understood that the thickness of the outer resistive layer 253 relative to the diameter of the drum 258 (that supports imaging surface 257) is exaggerated and not to scale for illustrative clarity. As shown in FIG. 9, charge roller 252 is spaced apart from the imaging surface 257 by a selectable gap (G), which corresponds to the spaced apart distance (D1) previously described in association with at least FIG. 1. In some examples, the gap (G) is any distance up to about 20 micrometers or even larger if adequate, uniform charge transfer can be achieved from the charge roller 252 to the imaging surface 257. In some examples, the gap (G) is any distance within a range from about 20 micrometers to about 80 micrometers, within which adequate, generally uniform charge transfer can be achieved from the charge roller 252 to the imaging surface 257, as described in more detail in further examples of the present disclosure, it will be understood that the term "generally uniform charge transfer" does not preclude the occurrence of at least some non-uniformities, such as filamentary streamer-type discharges. Moreover, in some examples, adjusting the AC voltage can improve the charge uniformity.

In some examples, the selectable gap (G) is greater than 80 micrometers.

As further shown in FIG. 9, in one example the charge roller 252 rotates about an axis 258 by means of a shaft 280 coupled to a drive mechanism 284 on at least one end of shaft 260 with shaft 280 rotationally supported within sleeves 282 at opposite ends of shaft 280. Meanwhile, the drum 258 (carrying imaging surface 257) rotates about an axis 286 by means of a shaft 288.

As further shown in FIG. 9, in some examples the printing system 250 includes a positioning assembly 270 having a positioner 272 coupled to the sleeve 282 and/or shaft 258 to enable selective movement along the Z orientation. This arrangement enables selectively changing the position (as represented by directional arrow P) of charge roller 282 vertically relative to imaging surface 257, thereby implementing a selected gap (G), such as spaced distance D1 in FIG. 1.

With further reference to FIG. 9, in some examples, positioner 272 and drive mechanism 274 are in cooperative relation to each other via a coupling mechanism 278 such that upon vertical movement of roller 252 along the Z orientation (as represented by directional arrow Z), the drive mechanism 274 is maintained in driving relation to shaft 258 despite the re-positioning of shaft 258.

In some examples, the roller 252, drum 256, drive mechanism 274 and positioner 272 are supported relative to a common frame 270 of a printing system. In some examples, the charge roller 252 is mounted to frame 279 independently from photoconductor drum 258 such that charge roller 252 is supported independently of photoconductor drum 256.

In one instance, in at least some aspects of printing system 250, this arrangement is deployed in an implementation, such as in an indigo digital press, in which the imaging surface 257 comprises a photoconducting sheet with a discontinuous seam region (not shown) resulting from overlap of two ends of the sheet. Such a seam region may be slightly depressed relative to other portions of the imaging surface. Accordingly, by providing the gap G for non-contact spaced charge-transfer between roller 252 and imaging surface 257, this arrangement avoids contact with such seam regions, thereby avoiding degradation issues traditionally associated with contact of a charge roller against the seam region.

In some instances, rotational torque to the drum 256 (supporting imaging surface 257) may be provided by a drive mechanism 277 that includes, among other things, a gear (not shown) attached to the shaft 288. In some examples, the drive mechanism 277 is coupled via coupler 278 to drive mechanism 274 such that rotational torque provided via each respective drive mechanism 274, 277 may be synchronized or so that a single drive assembly can serve or provide both drive mechanisms 274, 277.

In some examples, the coupler 278 is not omitted from system 250 because the drive mechanism 274 (associated with charge roller 252) is separate from, and independent of, drive mechanism 277. In other words, charge roller 252 has its own drive mechanism 274 (e.g. motor, gears, etc.) such that it is driven independently from drum 256.

Finally, the charge roller 252 defines an image area 289 relative to the Imaging surface 257.

In another aspect the charge roller 252 has a length (L1) that is slightly shorter than a length (L2) of the imaging surface 257 such that the charge roller 252 defines an image area across the imaging surface 257 sized to avoid creating a short between the charge roller 252 and a ground associated with the imaging surface 257.

Figure 10:
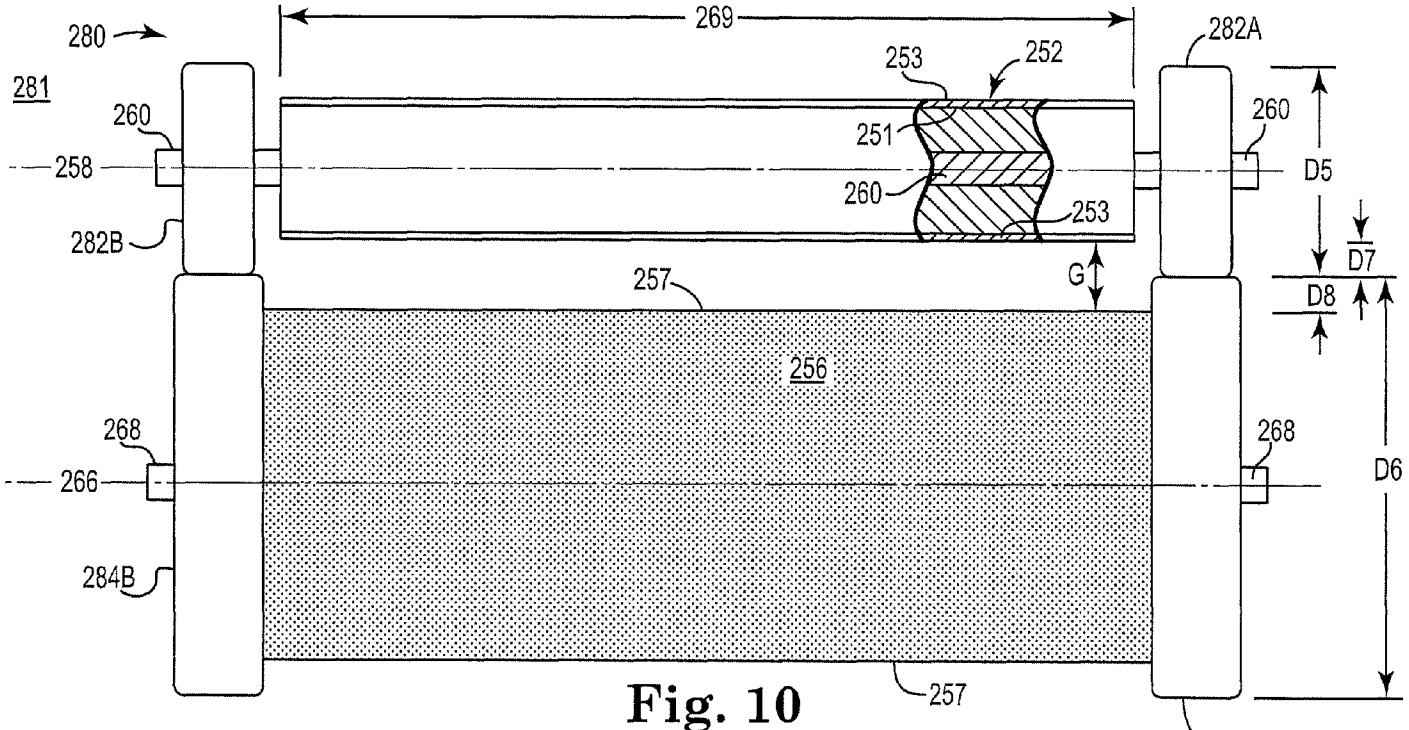
FIG. 10 is a front view schematically illustrating a charge roller in charge-transferring relation to an imaging drum while maintaining a selected controlled gap between the charge roller and the imaging drum, according to one example of the present disclosure.

FIG. 10 is diagram 281 schematically illustrating a charging assembly 280, according to one example of the present disclosure. In one example, the charging assembly 280 comprises at least substantially the same features and attributes as charging assembly 250, as previously described and illustrated in association with FIG. 9, except for providing for manual implementation of a selectable gap between charge roller 252 and imaging surface 257 instead of automatic implementation of a selectable gap as in the example represented by FIG. 9. In addition, in at least some examples illustrated via the system 280 of FIG. 10, charging roller 252 is driven (via drive mechanism 274 in FIG. 9) independently from drum 256 (driven via drive mechanism 277 in FIG. 8) without the presence of a coupler (e.g. coupler 278 in FIG. 9).

As shown in FIG. 10, charging assembly 280 includes drive rollers 282A, 282B releasably mounted (relative to axle 260) at opposite end portions of charging roller 252. Meanwhile, drive rollers 284A, 284B are releasably mounted (relative to axle 260) at opposite end portions of drum 256.

Drive rollers 282A, 282B have a diameter D5 while drive rollers 284A, 284B have a diameter D6. The diameter D5 of drive rollers 282A, 282B is sized to cause a periphery (e.g. outer surface) of the drive rollers 282A, 282B to extend beyond the surface of outer resistive layer 253 by a distance D7. Similarly, the diameter D6 is sized to cause a periphery (e.g. outer surface) of the drive rollers 284A, 284B to extend beyond the surface of imaging surface 257 by a distance D8. In one aspect, a sum of the distances D8 and D7 corresponds to a size of the gap G.

In some examples, the distance D8 remains fixed and serves to define a minimum gap G. In some examples, this minimum gap G corresponds to Dmin, as later described in association with FIG. 21.

In some examples, a maximum value of the distance D5, in combination with the diameter D6 of drum 256 yields to a maximum gap G. In some examples, this maximum gap G corresponds to Dmax, as later described in association with FIG. 21.

As shown in FIG. 10, just one size of drive rollers 282A, 282B is illustrated. However, it will be understood that drive roller 282A, 282B is replaceable with a pair of drive miters having a differently sized diameter to implement a different selectable gap G between the charging roller 252 and the Imaging surface 257.

Figure 11:
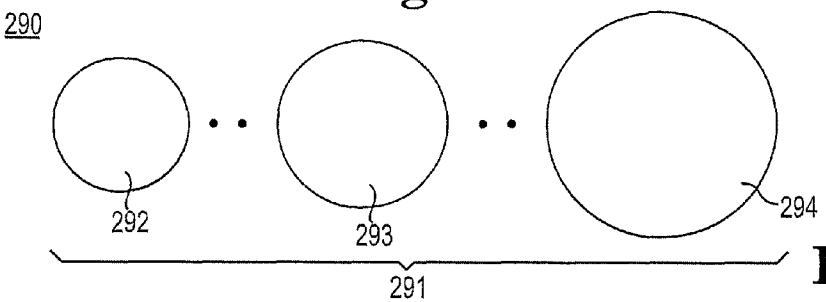
FIG. 11 is a diagram schematically illustrating an array of drive rollers, according to one example of the present disclosure.

FIG. 11 is a diagram 290 schematically illustrating an array 291 of drive rollers 292, 293, 294, according to one example of the present disclosure. Each drive roller 292, 293, 294 has a differently steed diameter, as shown in FIG. 9C. In one aspect, like drive rollers 282A, 282B, each drive roller 292, 293, 294 is releasably engageable relative to an end portion of the charging roller 252, such as being releasably coupled relative to axle 280 adjacent the end portion of the charging roller 252.

Like drive rollers 282A and 282B, any one of the drive rollers 282, 293, 294 is releasably engageable relative to a drive mechanism (such as, but not limited to, drive roller 284A, 284B in FIG. 10). Because of their different diameters, each drive roller 292, 293, 294 causes a different selectable gap G. In other words, the different diameters of the respective drive rollers 292, 293, 294 correspond to different respective selectable gaps G within a range of selectable gaps. Accordingly, to implement any particular selectable gap, a drive roller having a diameter associated with the particular selected gap is releasably coupled to the charging roller 252 for releasable engagement to drive roller 284A, 284B.

It will be understood that the array of drive rollers is not limited to just three differently steed rollers shown in FIG. 11, but can include a fewer or greater number of differently sized drive rollers. Moreover, while the rollers 292, 293, 294 are shown in FIG. 11 as single rollers, it will be understood that replacement of drive rollers 282A, 282B would involve the use a pair of rollers 292, a pair of rollers 294, or a pair of rollers 295 with a respective one of the pair of replacement rollers (e.g. 292) located at one end of charging roller 252 and the other respective one of the pair of replacement rollers (e.g. 292) located an opposite end of charging roller 252.

In some examples, the drive rollers 284A, 284B associated with the drum 258 (supporting imaging surface 257) are also replaceable with a pair of drive rollers having a different diameter than drive rollers 284A, 284B to implement a selectable gap G.

Figure 12:
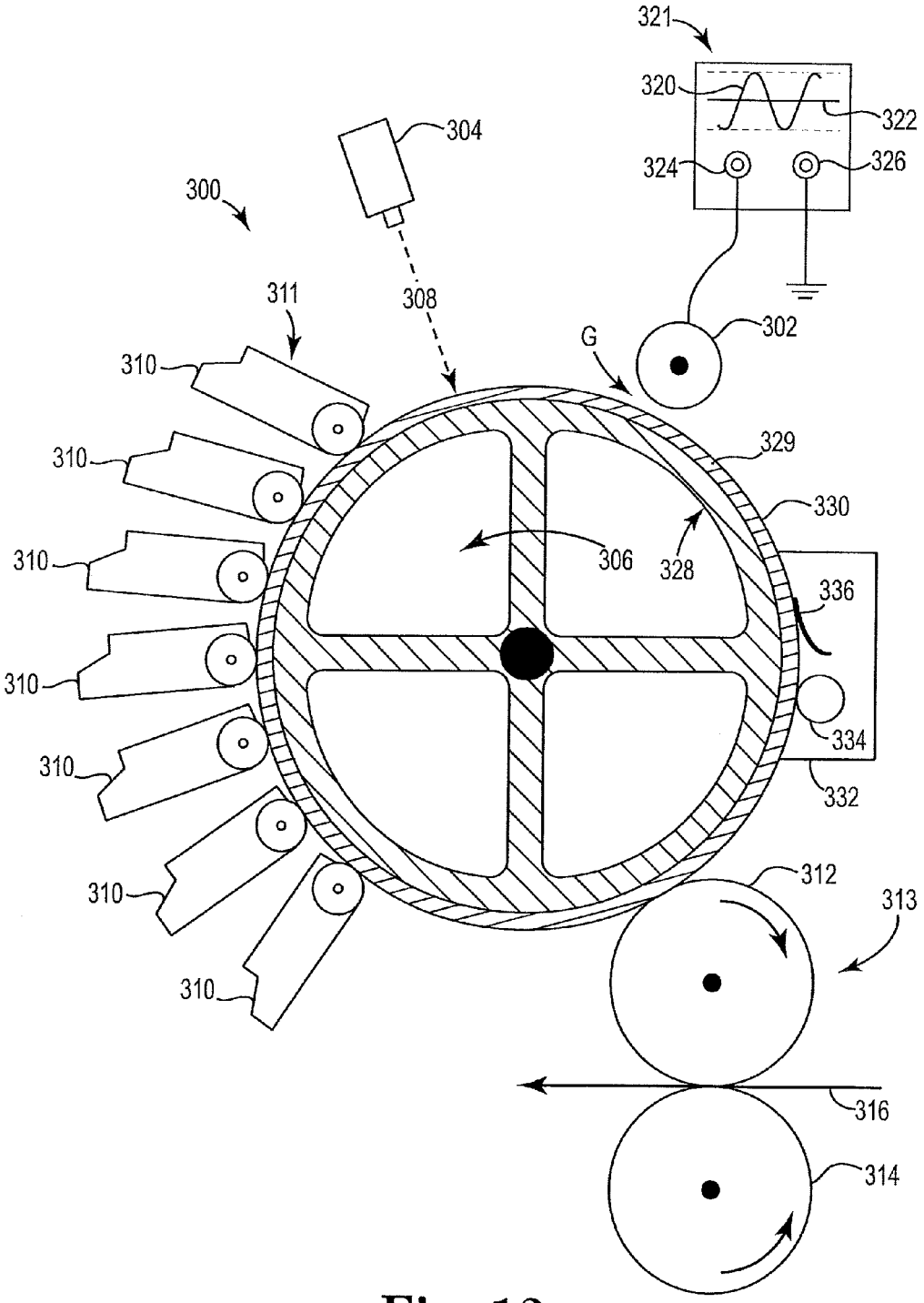
FIG. 12 is a side view schematically illustrating a liquid electrophotography printing system including a charge roller with a resistive coating at a selectable gap relative to an imaging surface, according to one example of the present disclosure.

FIG. 12 is a side view schematically illustrating a printing system 300 having a charge roller 302 in non-contact, charge-transferring relation with an Imaging surface 330, according to one example of the present disclosure. In one example, charge roller 302 includes at least substantially the same features and attributes as one of charge rollers 150, 252 in association with FIGS. 2 and 9, respectively. Accordingly, charge roller 302 includes an outer resistive layer in the manner previously described and illustrated. In one example, printing system 300 includes a liquid electrophotography printing system.

As shown in FIG. 10, printing system 300 includes a charge roller 302, a discharge source 304, a developer array 311, a transfer unit 313, a cleaner 332, and a power supply 321. In one aspect, charge roller 302 is in charge-transferring relation via gap G to an imaging surface 330 to produce a substantially uniform charge on imaging surface 330.

In one aspect, the discharge source 304 is aimed at the imaging surface 330 as indicated by an arrow 308. At least one ink developer roller 310 of array 311 is disposed in ink-dispensing relation with the imaging surface 330. While FIG. 12 depicts one example including seven ink dispenser rollers 310 in an array 311, in other examples fewer or more ink dispenser rollers 310 may be used. The transfer unit 313 is generally in ink-transferring relation with the Imaging surface 330 and defines a media movement path 316.

In some examples, the transfer 313 comprises an intermediate transfer drum 312 and an impression drum 314. The transfer drum 312 is rotationally coupled to and in direct contact with the imaging surface 330 while the impression drum 314 is rotationally coupled to the intermediate transfer drum 312. The paper movement path 318 is defined between the intermediate transfer drum 312 and the impression drum 314.

In one example, the imaging surface 330 comprises a photoconductive sheet 329 (e.g. such as a foil) carried by a drum 328. In some instances, the photoconductive sheet 329 is referred to as an organic photoconductor (ORG) because of the organic material forming the photoconductive sheet 329. In other instances, the photoconductive sheet 329 is referred to as a photo imaging plate (PIP). As discussed previously, fabric or other material (not shown) may be disposed between the drum 328 and the photoconductive sheet 329. In other examples the imaging surface 330 may comprise a dielectric drum or a photoconductor drum.

In one example, the discharge source 304 comprises a laser. In operation, when a beam of light from the laser reaches points on the electrostatically-charged imaging surface 330, the light discharges the surface at those points. A charge image is formed on the imaging surface 330 by scanning the beam of light across the imaging surface 330. In other examples, other types of image-forming energy sources or addressable discharging systems are used, such as an ion head or other gated atmospheric charge source. The particular type of image-forming energy source used in printing system 300 depends on what kind of imaging surface is being used.

In one example, printing system 300 includes cleaner 332 as noted above. For instance, cleaner 332 includes a roller element 334 and a scraping or brushing element 336, or other devices to remove any excess ink remaining on the imaging surface 330 after transferring imaged ink to the transfer roller 312. In some examples, roller element 334 includes a single roller while in other examples, roller element 334 includes at least two rollers, such as one wetting roller and one sponge roller.

In one example, the power supply 321 provides electric power with an AC component 320 and a DC component 322. The power supply is connected to the charge roller 302 through a first terminal 324 in electrical communication with the charge roller 302 and a second terminal 328 in electrical communication with ground.

In some examples, a voltage potential between the charge roller 302 and the ground plane (of the photoconductor) is a combination of a PC voltage and an AC voltage. In other examples, the voltage between the charge roller 302 and the ground plane is a DC voltage.

As noted above, by providing a charge roller 302 with a hard metal external surface (such as stainless steel or aluminum) and a hard resistive coating, greater longevity is achieved such that the charge roller may even become a permanent element within a printing system. The hard metal external surface in conjunction with a hard resistive coating prevents nicks and scratches that may otherwise occur during handling. In addition, the hard resistive coating materials (e.g. semiconductors and metal oxides) are not subject to electrical and chemical degradation typically associated with traditional charge rollers having conductively-loaded, rubber-based exterior portions.

Because a bare metal external surface of a charge roller would ordinarily be expected to produce an undesirable volume of high magnitude filamentary streamer discharges to imaging surface 330, by providing a resistive coating (according to some examples of the present disclosure) on top of the metal external surface of the body of the charge roller 302, a magnitude (e.g. amplitude) of the streamer discharges is suppressed to a sufficient degree to achieve desired printer operation. Stated differently, while the addition of the resistive coating to the metal external surface of the body of the charge roller 302 does not completely eliminate the formation and discharge of filamentary streamers, the presence of the resistive coating on the metal external surface of the charge roller 302 produces a substantially uniform charge distribution on the imaging surface 330, while simultaneously achieving a target charge (e.g. 1000 volts, in one example) at the imaging surface 330.

Figure 13:
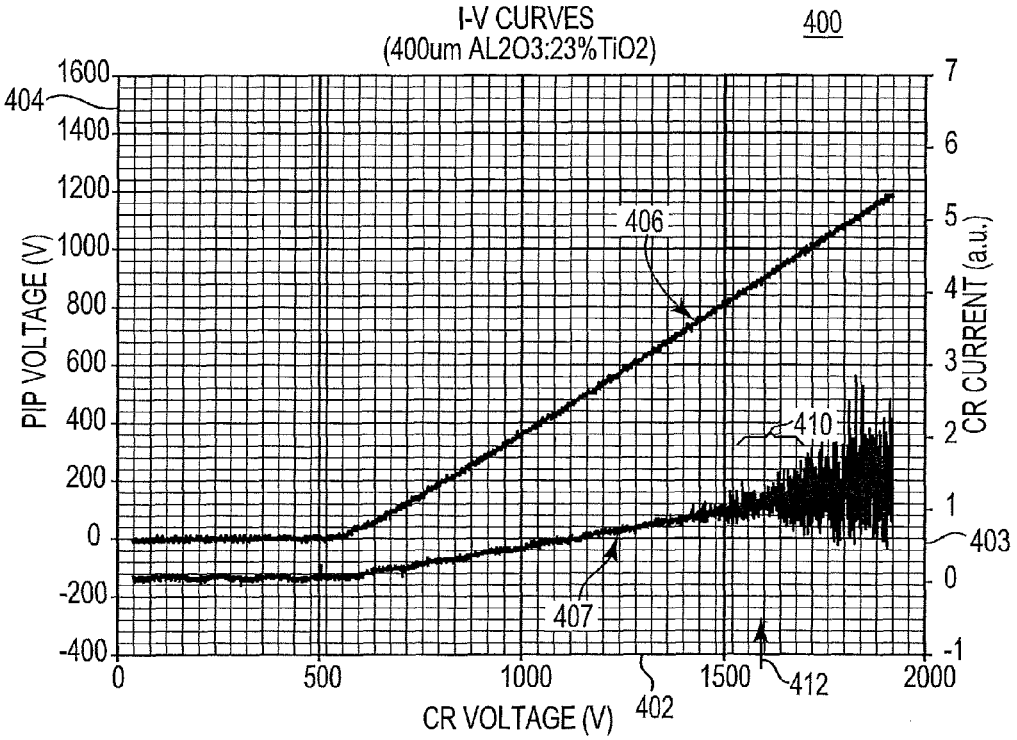
FIG. 13 is a graph schematically illustrating a current-voltage characteristic of a resistively-coated, metal charge roller in charge-transferring relation with an imaging surface, according to one example of the present disclosure.

FIG. 13 includes a graph, of a current-voltage characteristic for a charge roller to schematically illustrate the intensity (amplitude and/or quantity) of filamentary streamer discharges according to a type of resistive coating on top of the metal external surface of a charge roller, according to one example of the present disclosure.

FIG. 13 is a graph 400 schematically illustrating a current-voltage characteristic for a charge roller having a 400 micrometer resistive coating of Al2O3:TiO2 on its metal external surface. Graph 400 includes a voltage signal 408 plotted relative to a leftmost y-axis (404) of the voltage present at the imaging surface (indicated as PIP for photo imaging plate) and relative to an x-axis (402) corresponding to a bias voltage of the charge roller (CR). Meanwhile, graph 400 also includes a current signal (measurable with a 10 kHz bandwidth current probe) 407 plotted relative to a rightmost y-axis (403) and corresponding to the charges induced at an imaging surface. As shown in FIG. 13, as identified via marker 410, when a 1600 Voltage bias is present at charge roller (arrow 412), some filamentary streamer discharges may be present. However, these filamentary streamer discharges identified via marker 410 in FIG. 13 may have significantly lower amplitude than filamentary streamer discharges that would otherwise be exhibited by a bare metal charge roller.

In this example of the present disclosure of a 400 micrometer Al2O3:TiO2 outer resistive coating, the maximum amplitude of filamentary streamer discharges is about 11 mA, when the streamer amplitudes are measured by a 50 MHz bandwidth current probe. In some examples, this 11 mA maximum amplitude is 30× lower than the maximum amplitude of filamentary streamer discharges that would otherwise occur without a resistive coating (i.e. bare stainless steel).

In another aspect, FIG. 13 further illustrates that with this example 400 micrometer resistive coating (made of a Al2O3:TiO2 material), the streamer threshold (i.e. the voltage at which streamers generally begin to occur) may be increased to about 1400V whereas the streamer threshold for the bare metal is much lower, at 900V. With this in mind, if a printer is employed that requires an 800V photoconductor voltage, the charge roller may be biased at 1400V, which is at or below the elevated streamer threshold demonstrated via FIG. 13, in this scenario, the example charge roller may not have any filamentary streamer discharges. Accordingly, in some examples the outer resistive coating can sufficiently raise the streamer threshold to a level that generally precludes streamer formation.

In one example of the present disclosure, charge rollers have a construction include an $Al_2O_3$:23% $TiO_2$ resistive coating at a thickness of 400 micrometers. Because an estimated dielectric constant of $Al_2O_3$:$TiO_2$ is generally known to be about 15 in at least one example, a corresponding dielectric thickness was calculated to be about 27 micrometers for the 400 micrometer physical thickness.

Figure 14:
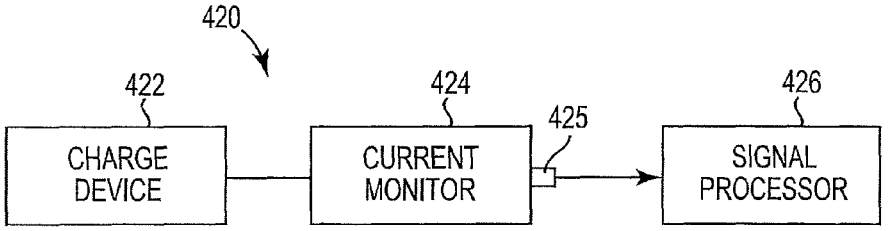
FIG. 14 is a block diagram schematically illustrating a current measurement assembly, according to one example of the present disclosure.

While not represented in FIG. 13, other example charge rollers can be constructed according to the general principles of the examples of the present disclosure. Some other example charge rollers include, but are not limited to, one charge roller with a 100 micrometer thick resistive coating of silicon carbide material and one charge roller with a 210 micrometer thick resistive coating of $Al_2O_3$:$TiO_2$ material FIG. 14 is a block diagram schematically illustrating a current monitoring assembly 420, according to one example of the present disclosure. As shown in FIG. 14, the current monitoring assembly 420 includes a charge device 422, a current monitor 424, and a signal processor 426. In one example, the current monitor 424 comprises a current transformer and isolates a current measurement from the direct current (DC) high voltage at the charging device 422. In some examples, the current monitor 424 includes a current transformer having a bandwidth of 300 Hz to 200 MHz, such as a yodel 2877 current monitor/transformer available from Pearson Electronics of Palo Alto, Calif. In one aspect, the device outputs 20 mV for a 20 mA current of a change device 422, such as one of the charge rollers 102, 150, 252, and 302 as previously described in association with FIGS. 7, 8, 9-11, and 12 respectively.

In one aspect the current monitor 424 is electrically connected to the charging device 422 and the current monitor 424 outputs a signal proportional to the current of the charge device 422. The output signal is presented to a connector 425 (such as a 50 Ohm connector) of current monitor 424 and passed to a signal processor 426 for further conditioning.

Figure 15:
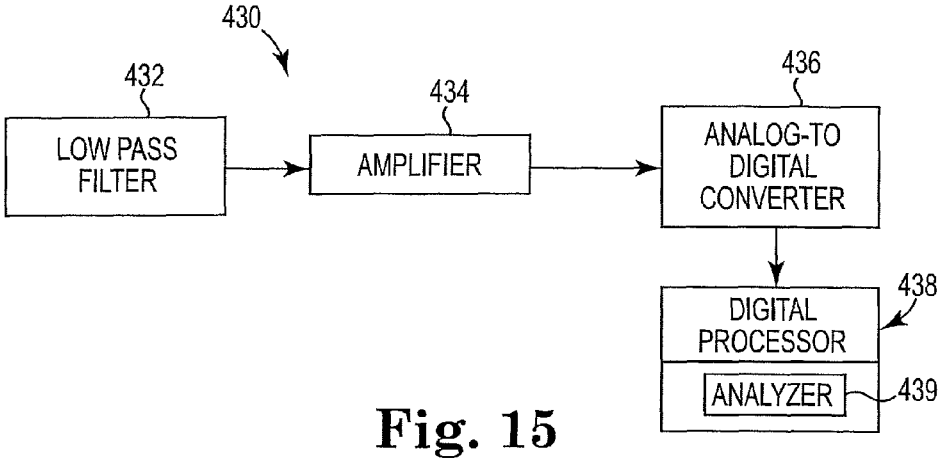
FIG. 15 is a block diagram schematically illustrating a signal processing assembly, according to one example of the present disclosure.

FIG. 15 is a block diagram schematically illustrating a signal processing assembly 430, according to one example of the present disclosure. In some examples, the signal processing system 430 provides one implementation of the signal processor 428 of current monitoring assembly 420 in FIG. 14. As shown in FIG. 15, the signal processing assembly 430 includes a low pass filter 432, an amplifier 434, an analog-to-digital converter (ADC) 436, and a digital processor 438 having an analyzer 439.

In one aspect, the low pass filter 432 comprises an analog low pass filter used to limit a high frequency content of the current signal of the charging device (e.g. charging device 402) and to stretch the current pulses of streamer discharges cut in time, in some example, the low pass filer comprises a Bessel low pass filter exhibiting an excellent pulse response and uniform group delay versus frequency. In one aspect, when the input pulse length goes to zero, the output of the analog low pass filter will converge on the impulse response of the filter, with the area under the output pulse equal to the area under the input pulse. Accordingly, the area under a streamer current pulse would be preserved in the output of the low pass filter as a measure of the intensify or magnitude of the pulse.

This output of the low pass filter is fed to the amplifier 434 to scale the output of the low pass filter, with the output of the amplifier then being fed to the analog-to-digital converter 436 to digitize the signal.

In one aspect the amplifier 434 and an analog-to-digital converter (ADC) 436 are used to scale and digitize the output of the low pass filter 432. In one aspect to avoid aliasing effects, the sample rate of the analog-to-digital converter 438 is chosen so that several samples are taken within the time duration of the impulse response of the low pass filter 432.

Figure 18:
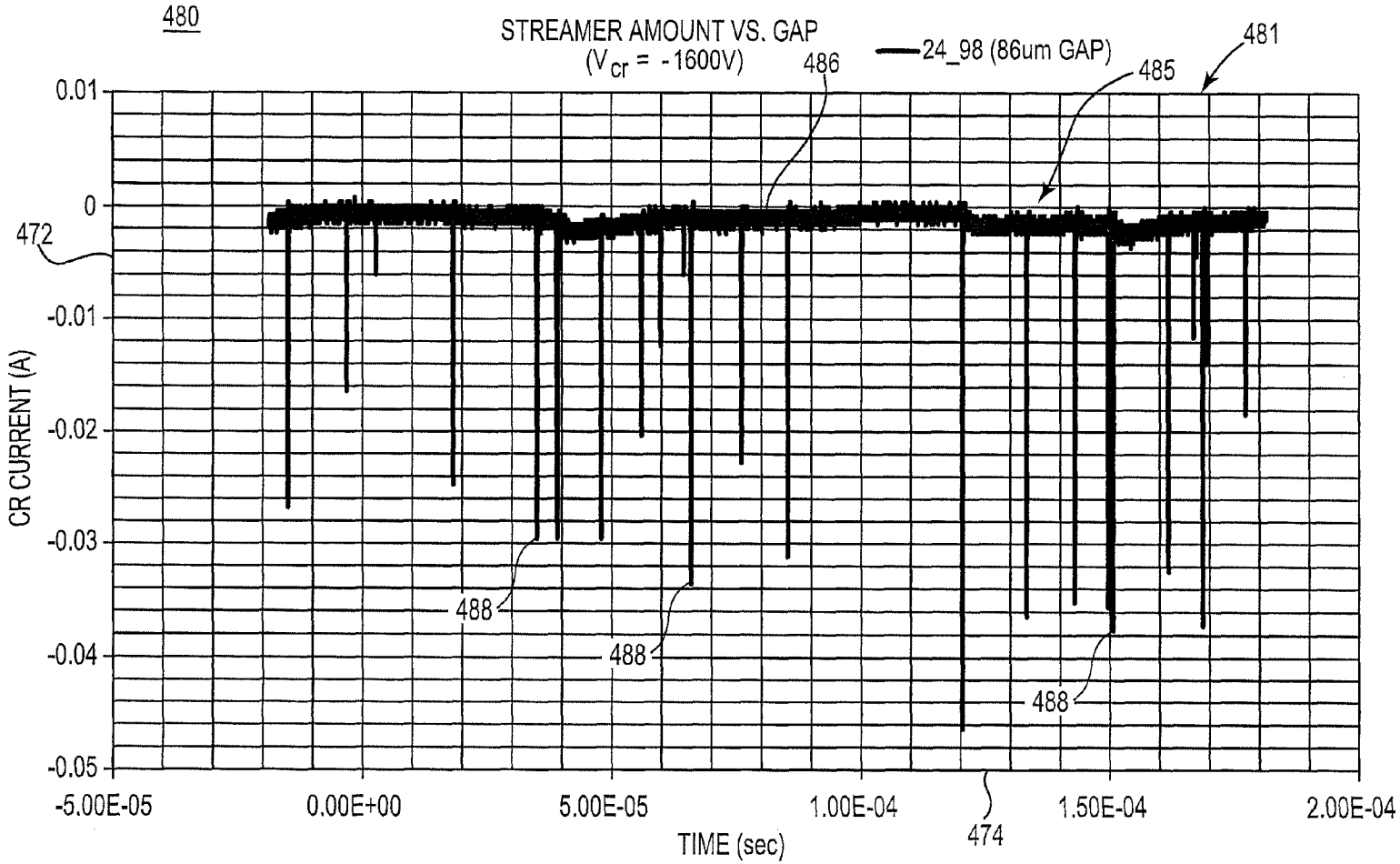
FIG. 18 is a diagram including a graph of an amplitude of streamer-type discharges for a second selected gap between a charge device and an imaging surface, according to one example of the present disclosure.

As further shown in FIG. 18, the output data samples produced by the analog-to-digital converter 438 are fed into a digital processor 438 having an analyzer 430. In some examples, the analyzer module 439 of the digital processor 438 includes analyzes the output data samples (e.g. output from the analog-to-digital converter 436) to count the number of the streamer current pulses over some time interval, to average the magnitude of the pulses over a selected time interval, or to average the magnitude of the pulses times the number of pulses over some time interval. These metrics correspond to more intense or more frequent streamer current pulses or both.

Figure 17:
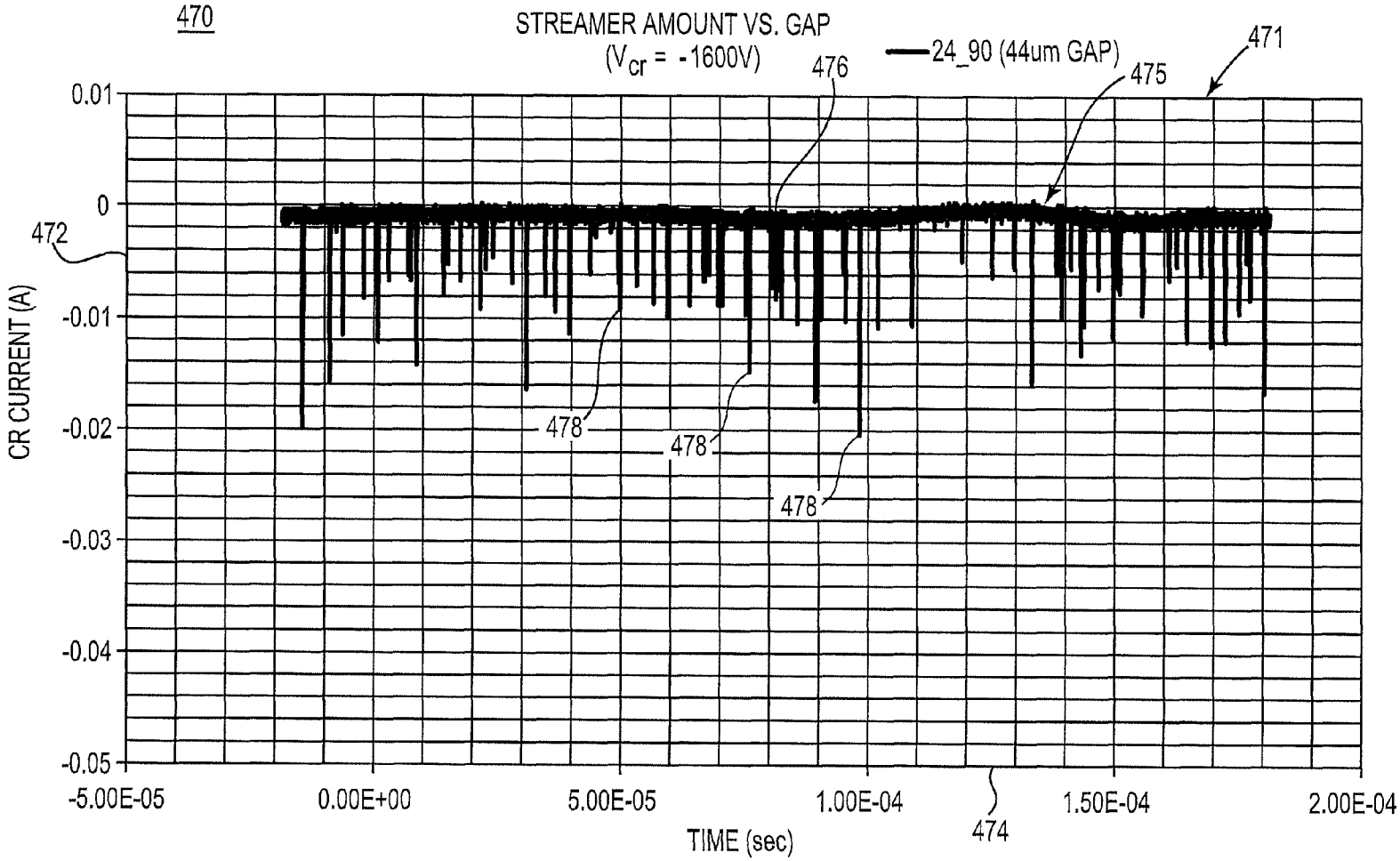
FIG. 17 is a diagram including a graph of an amplitude of streamer-type discharges for a first selected gap between a charge device and an imaging surface, according to one example of the present disclosure.

FIG. 18 is a diagram 460 including a graph 461 of streamer pulses when no gap (e.g. 0 micrometers) exists between a charging device and an imaging surface. As shown in FIG. 17, graph 461 plots a signal 465 relative to a y-axis 472 representing an amplitude of a current of a charging device and an x-axis 474 representing a length of time (seconds). Signal 465 includes a baseline portion 466 and a plurality of streamer pulses 468 occurring periodically throughout the length of time plotted in graph 461.

In one aspect, the charging device includes a charging roller (for which signal 465 is presented) having an outer resistive layer made of $Al_2O_3$:$TiO_2$ material and having a thickness of 210 micrometers, and at least generally consistent with the previously described examples of the present disclosure. In another aspect, the signal 465 is based on an applied voltage snob as Vcr=1140 V (DC)+Vac*sin(ωt). In one example, the angular frequency (ω) is about 10 kHz.

FIG. 17 is a diagram 470 including a graph 471 of streamer pulses for a selected gap (e.g. 44 micrometers) between a charging device and an imaging surface, according to one example of the present disclosure. As shown in FIG. 17, graph 471 plots a signal 475 relative to a y-axis 472 representing an amplitude of a current of a charging device and an x-axis 474 representing a length of time (seconds). Signal 475 includes a baseline portion 476 and a plurality of streamer pulses 478 occurring periodically throughout the length of time plotted in graph 471. In one example, signal 475 in FIG. 17 is produced via charge roller having the same characteristics (e.g. type of material and thickness forming the outer resistive layer, applied voltage signal, etc.) as represented by signal 465, except with signal 476 further representing the selected gap of 44 micrometers between the charging roller and the imaging surface.

FIG. 18 is a diagram 480 including a graph 481 of streamer pulses for a selected gap (e.g. 86 micrometers), according to one example of the present disclosure. Graph 481 comprises substantially the same features and attributes as graph 471 in FIG. 17, except plotting a different signal 485 representing observed streamer pulses occurring when an 88 micrometer gap (e.g. spaced distance D1 in FIG. 1) exists between a charging device and an imaging surface. The signal 485 includes a baseline portion 486 and a plurality of streamer pulses 488 occurring periodically throughout the plotted length of time. In one example, signal 485 in FIG. 18 is produced via charge roller having the same characteristics (e.g. type of material and thickness forming the outer resistive layer, applied voltage signal, etc.) as represented by signal 465, except with signal 485 further representing the selected gap of 86 micrometers between the charging roller and the imaging surface.

Figure 16:
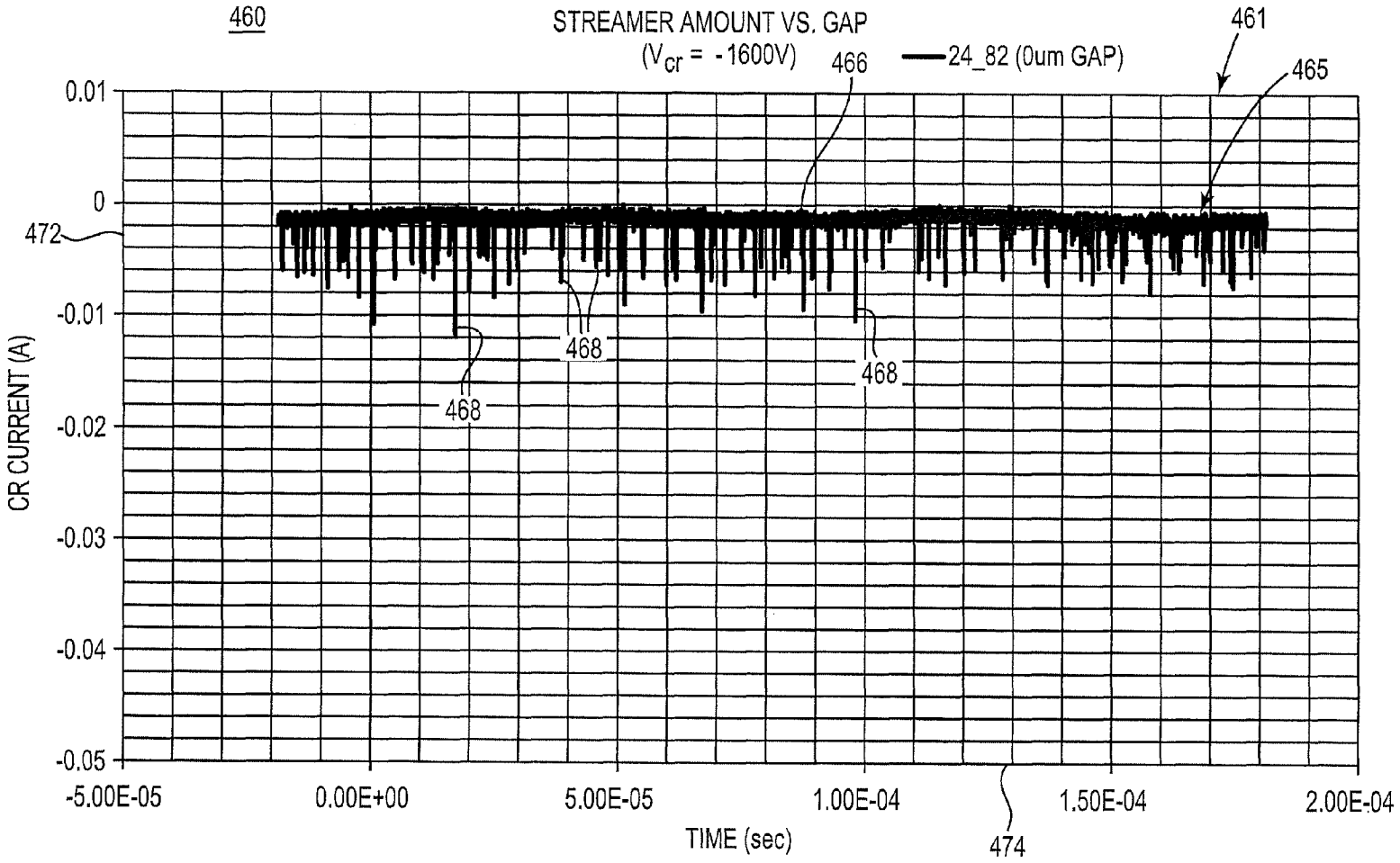
FIG. 16 is a diagram including a graph of an amplitude of streamer-type discharges between a charge device and an imaging surface, according to one example of the present disclosure.

A comparison of graphs 461, 471, and 481 in FIGS. 16, 17 and 18, respectively, reveals that the larger gap of 88 micrometers produces much greater amplitudes of streamer pulses 488 and a greater frequency of streamer pulses 488.

In one aspect, these graphs 461, 471, 481 demonstrate one way in which a control module 20 or distance control manager 30, 62 can track and evaluate an intensity of streamer discharges as one factor in evaluating the suitability of a particular gap G (e.g. spaced distance D1 in FIG. 1) for transferring charges from a charging device to an imaging surface.

If will be understood that a series of graphs like graphs 461, 471, 481 in FIGS. 18, 17, 18 (respectively) can be produced for a charging roller having a different type of coating and/or different thickness (at least consistent with the previously described examples of the present disclosure) than represented in FIGS. 16-18 in order to facilitate determining and implementing selectable gaps G between a charging roller and an imaging surface.

As previously described in association with at least FIG. 4, in some examples a feedback module 45 of a control module 20 includes a charge uniformity function 48 to monitor a charge uniformity of the imaging surface (e.g. imaging surface 28 in FIG. 1). This charge uniformity can be quantified in one of several different ways. In some examples, the charge uniformity of the imaging surface is quantified via an electrostatic voltmeter (moving or steady). In some examples, the charge uniformity of the imaging surface is determined by monitoring the current of the charging device 24, such as via current monitoring assembly 420 and signal processing assembly 430, as previously described in association with FIGS. 14 and 15, respectively. In some examples, the charge level at the imaging surface 28 is monitored to observe a peak-to-peak charge level of a given period of time or length, such as a length of a portion of the imaging surface or such as an arc length of a portion of the circumference of the charge roller. Such measurements are at least partially illustrated later in association with FIG. 19 and/or used in performing method 600.

In some examples, the charge uniformity also is evaluated by comparing a measured charge level at the imaging surface relative to an average voltage.

Figure 19:
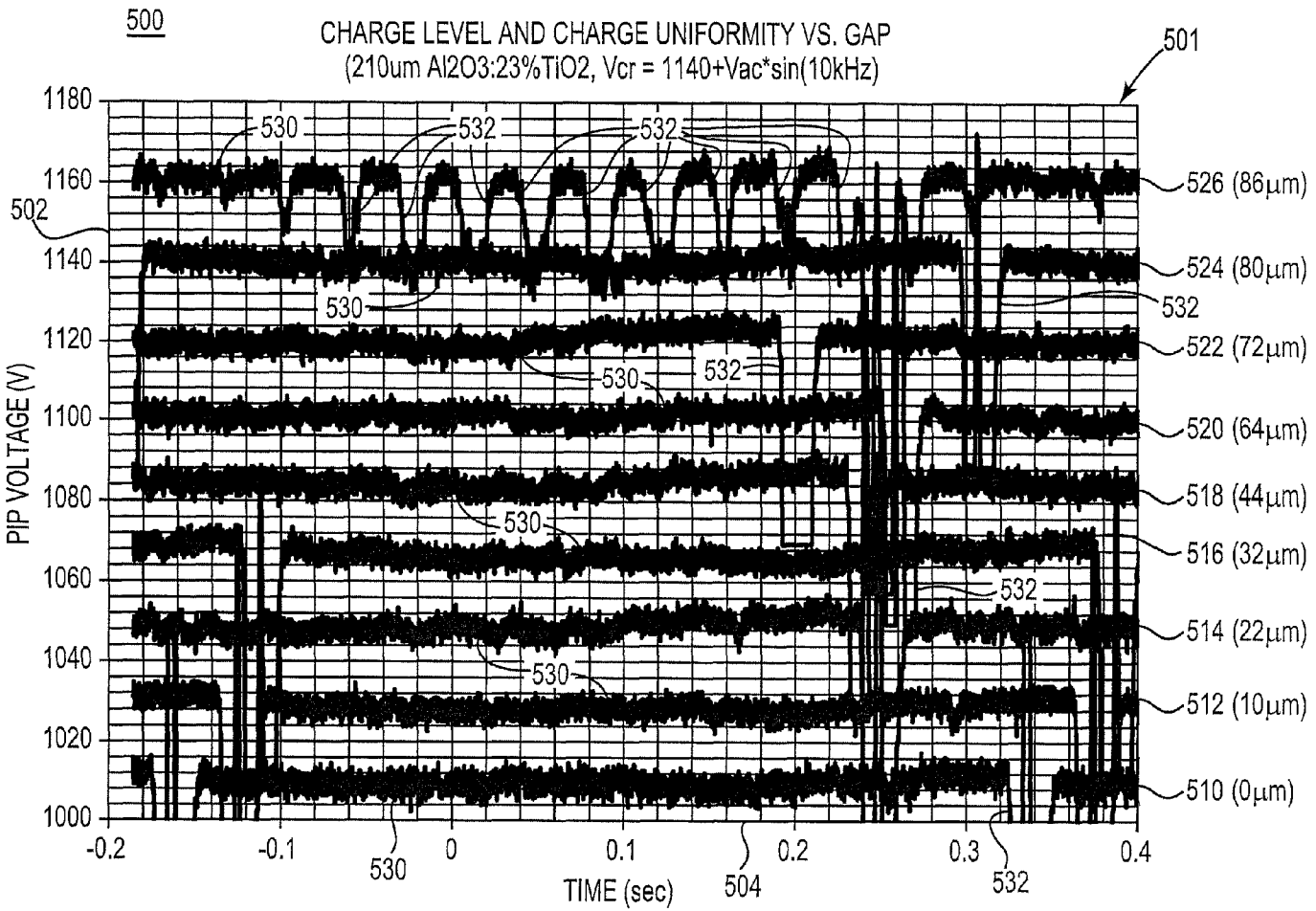
FIG. 19 is a diagram including a graph schematically illustrating a relative charge uniformity on an imaging surface according to a range of selectable gaps, according to one example of the present disclosure.

FIG. 19 is a diagram 500 including a graph 501 depicting a plurality of voltage signals with each signal indicative of a charge uniformity and a charge level at an imaging surface for a given gap G (e.g. spaced distance D1 in FIG. 1) between a charging device and an imaging surface, according to one example of the present disclosure. For comparison and illustrative purposes, an intentional 20 Volt offset was implemented to be able to differentiate the different signals shown in FIG. 19.

As shown in FIG. 19, graph 501 includes a y-axis 502 representing an amplitude of a voltage measured at the imaging surface and an x-axis 504 representing a length of time (seconds). Each signal (510, 512, 514, 518, 518, 520, 522, 524, 528) includes a baseline portion 530 and at least one abrupt voltage change(s) 532 occurring periodically throughout the length of time plotted in graph 501.

As demonstrated via graph 501, when a larger gap (e.g. 80 micrometers) is present such as represented via signal 526, the charge level at the imaging surface has a significant number of non-uniformities. For example, for signal 526, a significant duration of the signal 526 exhibits multiple, consecutive abrupt voltage changes 532, thereby indicating that the charge level is generally non-uniform. Accordingly, it would be concluded that the gap of 86 micrometers is too large for providing a generally uniform charge at an imaging surface as part of a printing operation. In some examples, a control module or charge uniformity function 48 employs a frequency threshold by which to evaluate a signal based on a quantity of abrupt voltage changes 532 within a set period of time and an amplitude threshold by which to evaluate a signal based on an amplitude of the abrupt voltage changes 532.

In some examples, this information from graph 501 about charge characteristics at an imaging surface, for a given type and thickness of outer resistive coating of a charge roller and for a given selectable gap, is employed in performing method 802.

Figure 20:
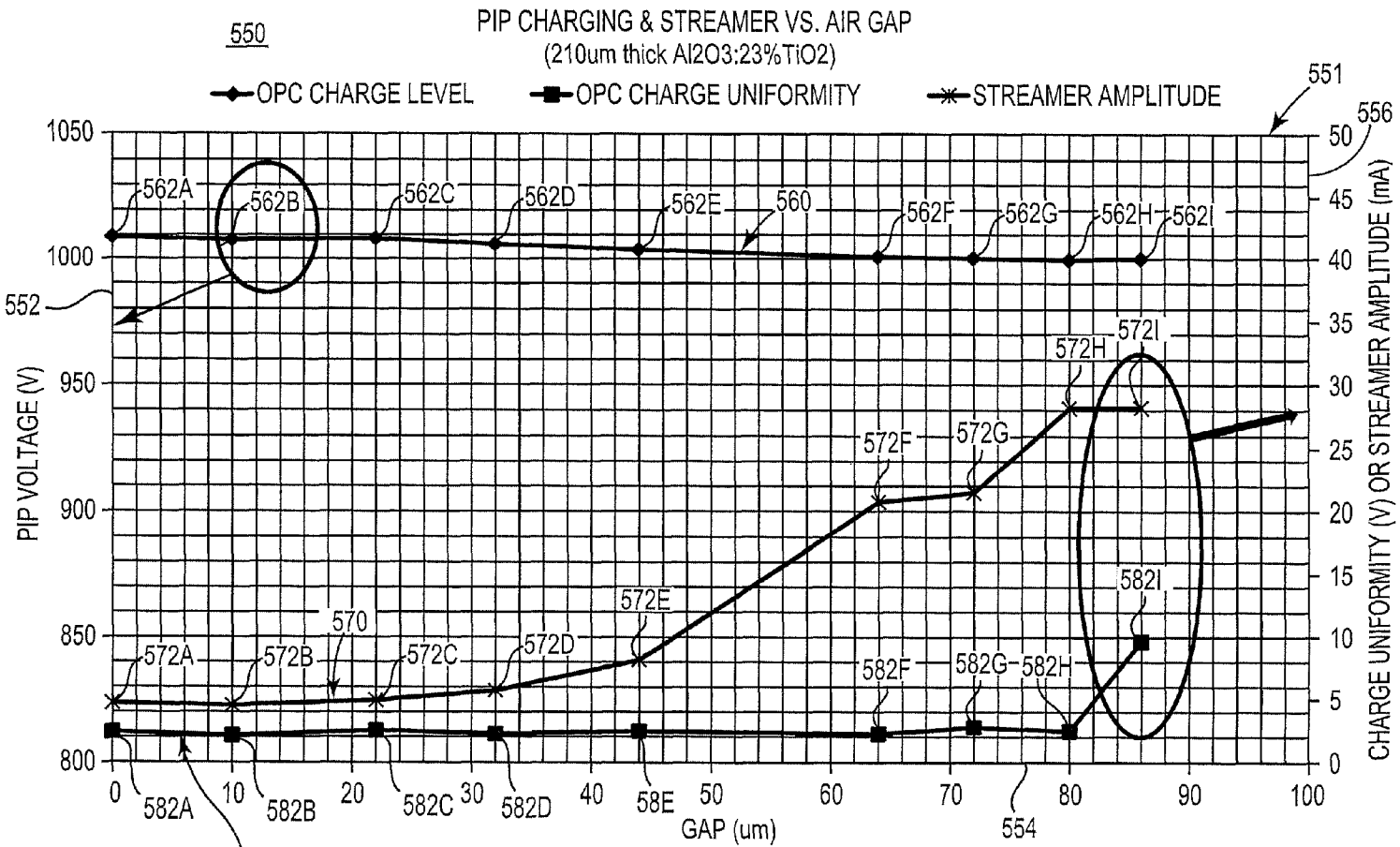
FIG. 20 is a diagram including a graph schematically illustrating charge characteristics at an imaging surface for a range of selectable gaps between a charge device and an imaging surface, according to one example of the present disclosure.

FIG. 20 is a diagram 550 including a graph 551 depicting signals indicative of charging characteristics at an imaging surface for a given gap G (e.g. spaced distance D1 in FIG. 1) between a charging device and an imaging surface, according to one example of the present disclosure. As shown in FIG. 20, graph 551 includes a first y-axis 552 representing an amplitude of a voltage measured at the imaging surface, an x-axis 554 representing a gap (micrometers) between a charging device and an imaging surface, and a second y-axis 556 representing a charge uniformity (Voltage) or a streamer amplitude (mA). In one aspect, graph 551 represents the charging characteristics exhibited for a charging device embodied as a charge roller (like charge rollers 102, 150, 252, 302 in FIGS. 7, 8, 9-11, and 12, respectively) having an inorganic outer resistive layer comprising a 210 micrometer thick Aluminum oxide titanium oxide ($Al_2O_3$:23% $TiO_2$) material. It will be understood that graphs similar to graph 551 can be made for outer resistive layers having different thicknesses and/or different materials.

As further shown in FIG. 20, graph 551 includes a first signal 560 representing a charge level (e.g. voltage amplitude) at the imaging surface, a second signal 570 representing an amplitude of streamer pulses between the charging device and the imaging surface, and a third signal 580 representing relative charge uniformity at the imaging surface. Each signal 560, 570, 580 is plotted according to a range of gaps (0 to 100 micrometers), as rep resented by the x-axis 554.

As shown in FIG. 20, the first signal 560 representing the charge level includes numerous measurement samples (indicated by the diamond shaped markers 562A, 562B, 562C, 562D, 562E, 562F, 562G, 562H, 562I) and in general terms reveals a slight but generally steady decline in the charge level as the gap G increases.

The second signal 570 representing the streamer intensity (between charging device and the imaging surface) includes numerous measurement samples (indicated by the asterisk shape markers 572A, 572B, 572C, 572D, 572E, 572F, 572G, 572H, 572I) and in general terms reveals general consistency in the amplitude of steamer pulses as the gap G increases until the gap reaches about 40 micrometers (see measurement sample 572E) at which time the signal begins to increase and then abruptly increases for gaps exceeding 50 micrometers (see measurement samples 582F-582I)

The third signal 680 representing the charge uniformity includes numerous measurement samples (indicated by the square-shaped markers 582A, 582B, 582C, 582D, 582E, 582F, 582G, 582H, 582I). In general terms, signal 580 reveals moderate variability of the peak-to-peak measurements as the gap G increases until the gap reaches about 80 micrometers (see measurement sample 572H) at which time the signal abruptly increases for gaps exceeding 80 micrometers (see measurement samples 572I).

Figure 21:
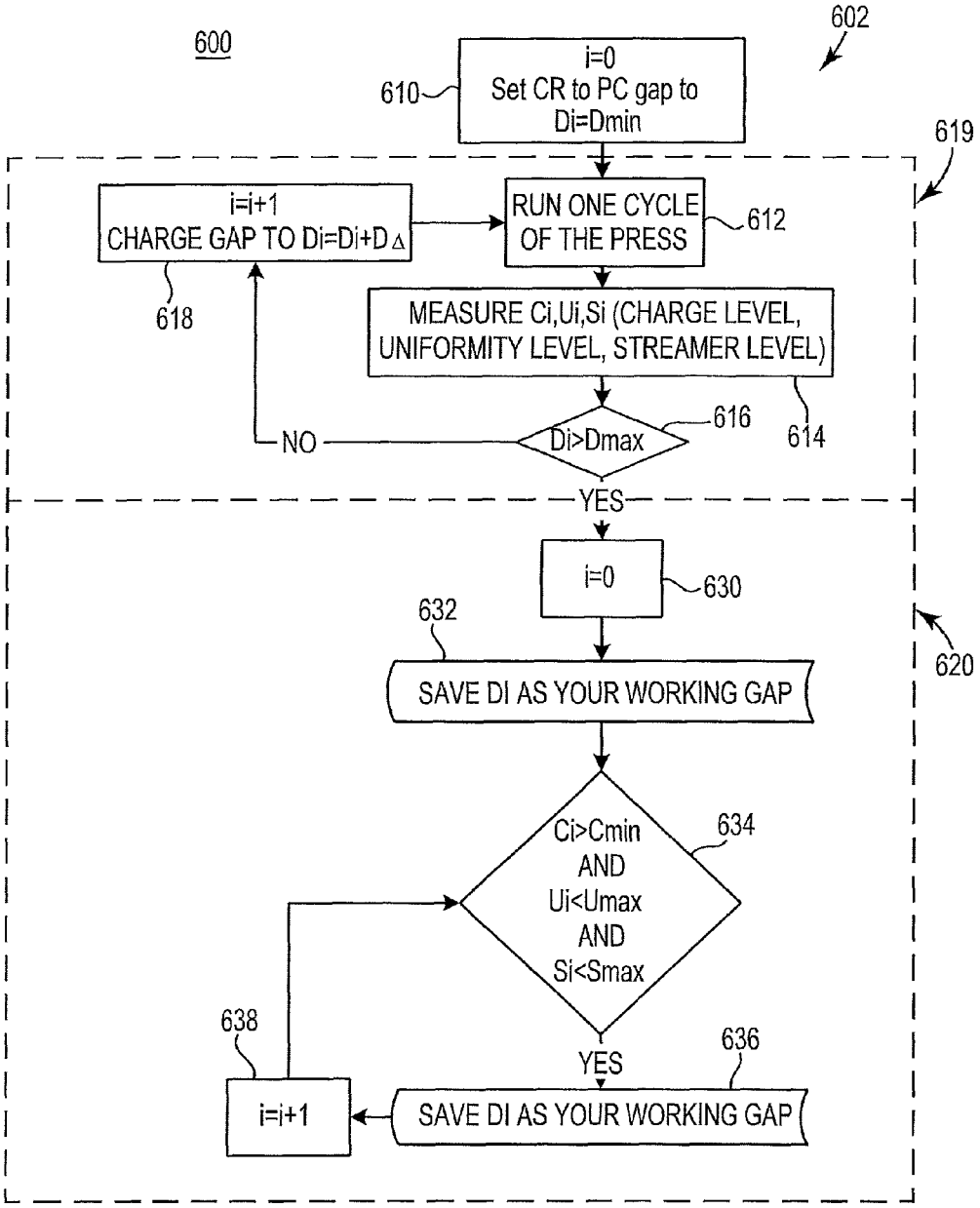
FIG. 21 is a flow diagram schematically illustrating a method of determining and optimizing a range of selectable gaps between a charge device and an imaging surface, according to an example of the present disclosure.

In some examples, this graph 551 shown in FIG. 20 is producible via performing method 602 in FIG. 21, and in particular, performing loop portion 619 of method 802 in FIG. 21.

In some examples, the results of graph 551 in FIG. 20 is used to the context of other information regarding She printing environment, such as humidity, temperature, altitude, etc. to determine the lower and upper boundaries of the range of selectable gaps that produce acceptable print quality.

FIG. 21 is a flow diagram 600 schematically illustrating a method 602 of optimizing a gap or spaced distance between a charging device and an imaging surface, according to one example of the present disclosure. In one example, method 802 is performed via the components, features, modules, and systems previously described in association with FIGS. 1-20, in one example, method 602 is performed via components, features, modules, and systems other than those previously described in association with FIGS. 1-20.

As shown in FIG. 21, at 810 method 800 includes setting an initial gap value equal to a minimum gap size. In some examples, a minimum gap size (Dmin) equals 20 micrometers. This minimum selectable gap is set to ensure that contact does not inadvertently occur between the charging device and the imaging surface in view of printer operation dynamics and variable manufacturing tolerances of the moving components of those respective elements. Accordingly, in some examples, a minimum gap size (Dmin) is pre-selected to be greater than a typical "runout" of the charging device (e.g. a charging roller) to further ensure that contact does not inadvertently occur between the charging device and the imaging surface. In one example, the "runout" includes the deviation from the desired form of the surface (of the charging roller) of revolution detectable during full rotation of the charging roller on a datum axis.

At 612, method 602 includes operating the press or printing system for one or more cycles and at 614, measuring the charge level, charge uniformity and streamer discharge amplitudes. At 616, method 616 queries whether the current, iteration of gap size is greater than a maximum gap (Dmax). In some examples, a maximum gap size (Dmax) is 80 micrometers. This maximum gap is set to avoid negative effects of high amplitude streamer impulses and significant charge non-uniformity, both which contribute to irregular charge distributions at the imaging surface, which in turn can degrade print quality and cause reduced longevity of the respective components.

If there is a negative response to the query at 616 (i.e. the current iteration of gap size is not greater than Dmax), at 618 method 602 increases the gap by an incremental quantity (such as, but not limited to, 1 micrometer, 2 micrometers, 5 micrometers, 10 micrometers). In some examples, method 602 includes automatically performing the increase in size of the gap at 618.

In some examples, method 602 includes manually implementing the increase in the size of the gap at 618. In some examples, a manual implementation of the increase in the size of the gap at 618 is facilitated via a user interface providing at least some implementation information to the operator. In some examples, the implementation information is provided via a control portion like control portion 50 (FIG. 5) that determines and indicates the charging characteristics via text or graphically (via a user interface 58 in FIG. 5) and which electrical and/or mechanical adjustments to make. In addition, this displayable implementation information would indicate a recommendation for the incremental increase in gap size and a corresponding diameter of a drive roller (for the charging roller) to implement the recommended incremental increase in the selected gap.

After the gap size has been increased, at 612 method 602 again performs one or more cycles of a printing operation, after which method 602 proceeds to measuring charge characteristics at 614 and querying gap size 616. This loop 619 is repeated until on one of the passes through loop, at 616 the gap D1 becomes greater than Dmax. The results of the iterations through loop 619 are used to produce a graph like graph 551 in FIG. 20.

With further reference to FIG. 21, in some examples method 602 includes a second loop 620 to find the best gap from a range of gaps (determined according to loop 619). Accordingly, the second loop 620 begins at 630 to establish an initial iteration (Di=0).

At 632, method 602 proceeds to set Di as a working gap. At 634, method 600 next begins an evaluation of which gap size within the range between Dmin and Dmax is the best gap at which to operate the printing system in view of the test cycles performed (at 612) for each respective gap. At 634, the query includes, for each tested gap size, comparing the measured charge level Ci (for a particular gap size) to a minimum charge level (Cmin) to ensure that a sufficient charging level is maintained at the imaging surface to reset in a successful charging operation. In addition, the query at 634 includes comparing the measured charge uniformity (Ui) (for a particular gap size) to a maximum charge uniformity Umax (e.g. uniformity threshold) to ensure that any non-uniformities in charging do not sufficiently inhibit an adequate imposition of latent images on the imaging surface in a later step of a printing operation. Finally, the query at 634 includes comparing the measured streamer amplitude (for a particular gap size) to a maximum streamer amplitude Smax (streamer amplitude threshold) above which printing quality begins to degrade and the components begin to suffer undesired degradation over time.

After each resolution of query 634, method 602 proceeds with saving the gap from that iteration as a working gap, and then the next incremented gap size is submitted to query 634.

Accordingly, in some examples, loop 620 is performed for each incremented gap to choose the largest tolerable gap until the criteria for charging level, charge uniformly, and streamer amplitude are no longer met, in view of the mechanical press tolerances, desired print quality, and the minimum air gap.

In some examples, loop 620 is repeated for several different AC voltages (Vac) where a voltage of the charge roller (Vcr) equals Vdc+Vac*sin (ω t) to determine the best change uniformity or in case the conditions at 634 are not met.

Figure 22:
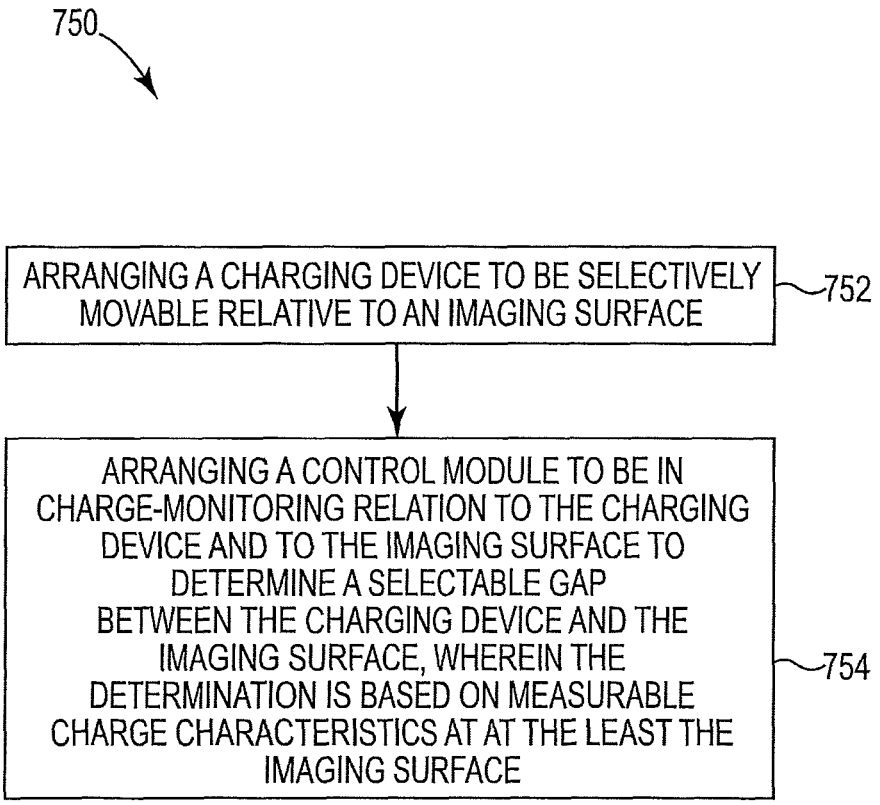
FIG. 22 is a flow diagram schematically illustrating a method of manufacturing a charging assembly, according to an example of the present disclosure.

FIG. 22 is a flow diagram schematically illustrating a method 750 of manufacturing a charging assembly, according to at least one example of the present disclosure. In some examples, method 750 is performed via at least some of the components, features, modules, and systems previously described in association with FIGS. 1-21, in some examples, method 750 is performed via components, features, modules, and systems other than those previously described in association with FIGS. 1-21.

As shown at 752 in FIG. 22, method 760 includes arranging a charging device to be selectively movable relative to an imaging surface. In some examples, the charging device is selectively movable during operation of a press. At 754, method 750 includes arranging a control module to be in charge-monitoring relation to the charging device and to imaging surface to determine a selectable gap, between the charging device and the imaging surface. In some examples, the determination is based on measurable charge characteristics at at least the imaging surface. In some examples, the determination of the selectable gap is performable during operation of the press. In some examples, a selected gap is implemented during operation of the press.

With reference to the many examples throughout the present disclosure, in some examples, measurement information about the charge level, charge uniformity and/or streamer amplitudes also can be used diagnostically. In particular, once a charging device already is operating according to an optimized non-contact mode of charge-transferring relation to the imaging surface, aberrations in the expected charge level, charge uniformity, and/or streamer amplitudes for a particular gap (spaced distance D1 in FIG. 1) can be used to alert an operator about problematic performance and potential diagnosis regarding which components of the charging portion of the printing system may not be working properly.

At least some examples of the present disclosure provide for closed loop control of a selectable gap between a charging device and an imaging surface of a printing system in which the charging device is in non-contact charge-transferring relation to the imaging surface. In some examples, the closed loop control mechanism enables determining a range of selectable gaps in which the charging device can provide a charge that is generally uniformly distributed across the imaging surface. In some examples, during printing operation of the printing system, the closed loop control mechanism automatically implements a selectable gap different than a selectable gap that was implemented upon during initial printing operations.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

What is claimed is:

1. A charging assembly comprising:

a charging roller including an outer inorganic resistive coating and positionable into charge-transferring relation to an imaging surface via a selectable gap between the charging roller and the imaging surface;

a control module to automatically determine the selectable gap between the charging roller and an imaging surface based on at least a streamer amplitude parameter associated with at least the charging roller; and a plurality of drive rollers with each drive roller having a different diameter, wherein each drive roller is releasably engageable relative to an end portion of the charging roller and the different diameters of the respective drive rollers correspond to different selectable gaps within a range of selectable gaps.

2. The charging assembly of claim 1, wherein control module further determines the selectable gap based on a charge level at the imaging surface and based on a charge uniformity parameter associated with the imaging surface.

3. The charging assembly of claim 2, wherein the control module automatically implements the selectable gap during system operation for printing and comprises:

a positioner coupled to the charging roller to enable selective movement of the charging roller relative to a position of the imaging surface to cause and maintain the selectable gap; and a feedback module in communication with the positioner to determine a quantity of the selectable gap between a minimum value and a maximum value of a range of selectable gaps and based on the current parameter, the charge uniformity parameter, and the streamer amplitude parameter.

4. The charging assembly of claim 3, wherein the feedback module facilitates selection of the quantity of the selectable gap based on, at least:

a comparison of the charge uniformity parameter relative to a uniformity threshold associated with the maximum value of the range of selectable gaps; and a comparison of the streamer amplitude parameter relative to a streamer amplitude threshold associated with at least the maximum value of the range of selectable gaps.

5. The charging assembly of claim 1, wherein the imaging surface is disposed externally on a photoconductor drum, wherein the charging roller is mounted to a frame independently of the photoconductor drum, and the charging assembly comprises:

a coupling mechanism to couple a drive mechanism of the charging roller relative to a drive mechanism of the photoconductor drum.

6. A computer software product comprising a non-transitory tangible medium readable by a processor, the medium having stored thereon a set of instructions for operating an electrophotographic printing system, the system including:

a charge roller disposed to charge an imaging surface on which a latent image for printing is formed, the instructions comprising a set of instructions which, when loaded into a memory and executed by the processor, causes closed-loop control of a selectable non-contact distance between the charge roller and the imaging surface; and a plurality of drive rollers with each drive roller having a different diameter, wherein each drive roller is releasably engageable relative to an end portion of the charging roller and the different diameters of the respective drive rollers correspond to different selectable gaps within a range of selectable gaps.

7. The computer software product of claim 6, comprising:

providing the closed loop control to include a range of selectable non-contact distances between the charge roller and the imaging surface that can be selected and implemented during printing operation of the printing system.

8. The computer software product of claim 6, wherein the closed loop control comprises:

measuring an charge amplitude and a charge uniformity at the imaging surface; and implementing the selectable non-contact distance during printing operation of the printing system, based on the measured amplitude of streamer-type discharges, the measured charge amplitude parameter, and the measured charge uniformity parameter, via moving a position of the charge roller relative to the imaging surface.

9. The computer software product of claim 6, wherein the charge roller to which the closed loop control is applied comprises an outer layer formed of an inorganic, non-polymeric resistive material.

10. The computer software product of claim 6, wherein the closed loop control comprises:

measuring an amplitude of streamer-type discharges between the charge roller and the imaging surface; and implementing the selectable non-contact distance during printing operation of the printing system, based on at least the measured amplitude of streamer-type discharges, via moving a position of the charge roller relative to the imaging surface.

11. A method of manufacturing a printing system, comprising:

arranging a charging device to be selectively movable relative to an imaging surface;

arranging a control module to be in charge-monitoring relation to the charging device and to the imaging surface to determine a selectable gap between the charging device and the imaging surface, wherein the determination is based on measurable charge characteristics at at least the imaging surface;

providing a plurality of drive rollers with each drive roller having a different diameter, wherein each drive roller is releasably engageable relative to an end portion of the charging device; and arranging each drive roller to be releasably engageable relative to a drive mechanism to cause a respective one of the selectable gaps within the range, with the different diameters of the respective drive rollers corresponding to the different respective selectable gaps within the range.

12. The method of claim 11, wherein the measurable charge characteristics include an intensity parameter associated with streamer discharges between the charging device and the imaging surface, and wherein the selectable gap is one of a range of selectable gaps in which an upper boundary of the range is determined by comparing measurements of the intensity parameter relative to a maximum intensity parameter.

13. The method of claim 12, wherein the intensity parameter corresponds to an amplitude of the streamer discharges and wherein arranging the control module comprises:

arranging a current measurement module in electrical communication with the charging device to identify each streamer discharge and to quantify the amplitude of each streamer discharge.

* * * * *